US010349754B2

(12) United States Patent
Kang et al.

(10) Patent No.: US 10,349,754 B2
(45) Date of Patent: Jul. 16, 2019

(54) BABY CARRIER

(71) Applicant: Samsung Electronics Co., Ltd., Suwon-si, Gyeonggi-do (KR)

(72) Inventors: Ji-young Kang, Anyang-si (KR); Yeo-hwan Yoon, Seoul (KR); Jung-hun Lee, Gwangmyeong-si (KR); Ju-ho Kim, Yongin-si (KR); Do-hyeong Park, Seoul (KR); Jae-ho Baek, Seoul (KR); Seong-cheol Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 72 days.

(21) Appl. No.: 15/718,875

(22) Filed: Sep. 28, 2017

(65) Prior Publication Data

US 2018/0084923 A1 Mar. 29, 2018

Related U.S. Application Data

(60) Provisional application No. 62/401,118, filed on Sep. 28, 2016, provisional application No. 62/411,766, filed on Oct. 24, 2016.

(30) Foreign Application Priority Data

Jan. 5, 2017 (KR) ..... 10-2017-0001747

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/160
See application file for complete search history.

(56) References Cited

U.S. PATENT DOCUMENTS 1,464,404 A * 8/1923 Blekastad ..... A47D 13/025 224/159
4,389,005 A * 6/1983 Cable ..... A47D 13/025 224/159
4,790,459 A * 12/1988 Moseley ..... A47D 13/025 224/159
5,205,450 A * 4/1993 Derosier ..... A47D 13/025 224/161

(Continued)

FOREIGN PATENT DOCUMENTS

JP 4145982 B2 9/2008
KR 20-2010-0007127 U 7/2010

(Continued)

*Primary Examiner* — Derek J Battisti
(74) *Attorney, Agent, or Firm* — Jefferson IP Law, LLP

(57) ABSTRACT

A baby carrier is provided. The baby carrier includes a body part, a pair of shoulder bands coupled to opposite sides of an upper portion of the body part, a waist band coupled to a lower portion of the body part, a load control unit which is coupled to the waist band and is changed to any one posture of a first posture and a second posture to switch a load-applied direction. A ratio of loads applied to the shoulder bands and the waist band is changed in response to the load control unit being changed from the one posture of the first posture and the second posture to the other posture of the first posture and the second posture.

4 Claims, 42 Drawing Sheets

(56) References Cited

U.S. PATENT DOCUMENTS

| | | | | |
|---|---|---|---|---|
| 5,641,101 | A * | 6/1997 | Nakayama | A47D 13/025 224/159 |
| 6,789,710 | B1 * | 9/2004 | Szatkowski | A47D 13/025 224/159 |
| 9,314,113 | B1 * | 4/2016 | Lehan | A47D 13/025 |
| 9,596,947 | B2 * | 3/2017 | Lee | A47D 13/025 |
| 10,045,634 | B2 * | 8/2018 | Salazar | A47D 13/025 |
| 10,076,194 | B2 * | 9/2018 | Wikner | A47D 13/025 |
| 2014/0014692 | A1 | 1/2014 | Andren et al. | |
| 2014/0263491 | A1 * | 9/2014 | Telford | A47D 13/025 224/160 |

FOREIGN PATENT DOCUMENTS

| | | | |
|---|---|---|---|
| KR | 10-2012-0082651 | A | 7/2012 |
| KR | 20-0462354 | Y1 | 9/2012 |
| KR | 10-1453460 | B1 | 10/2014 |
| KR | 20-0476693 | Y1 | 3/2015 |
| KR | 10-2015-0036271 | A | 4/2015 |
| KR | 10-1542837 | B1 | 8/2015 |
| KR | 10-2016-0034547 | A | 3/2016 |

* cited by examiner

BABY CARRIER

CROSS-REFERENCE TO RELATED APPLICATION(S)

This application claims the benefit under 35 U.S.C. § 119(e) of a U.S. Provisional application filed on Sep. 28, 2016 in the U.S. Patent and Trademark Office and assigned Ser. No. 62/401,118, and of a U.S. Provisional application filed on Oct. 24, 2016 in the U.S. Patent and Trademark Office and assigned Ser. No. 62/411,766, and under 35 U.S.C. § 119(a) of a Korean patent application filed on Jan. 5, 2017 in the Korean Intellectual Property Office and assigned Serial number 10-2017-0001747, the entire disclosure of each of which is hereby incorporated by reference.

TECHNICAL FIELD

The present disclosure relates to a baby carrier. More particularly, the present disclosure relates to a baby carrier capable of adjusting a ratio of loads transferred to a shoulder band and a waist band.

BACKGROUND

In general, in response to a baby being sat on a baby sling which may carry a baby on the user's back or hold the baby to the user' chest, a load may be vertically applied and may be concentrated on the user's shoulders. Accordingly, the load may be hard on the user's shoulders.

In recent years, hipseats which may hold a baby to disperse the baby's weight to the user's waist and pelvis may have been used. However, the baby's weight may be mostly concentrated on the user's waist in hipseats and may be hard on the user's waist.

In the baby slings and hipseats in the related art, the baby's weight may be concentrated on a specific body part and the user may feel pain while the user wears the baby carrier and hipseat for a long time.

To switch the mode to the hipseat mode in the baby sling mode in the structure that the baby sling and the hipseat are combined, the user has to combine the hipseat with the baby sling after the user releases wearing of the baby sling and puts the baby down. To switch the mode to the baby sling mode in the hipseat mode, the user has to separate the hipseat from the baby sling after the user put the baby on the hipseat down and unbuckles the belt. Accordingly, the mode switching between the baby sling mode and the hipseat mode is cumbersome. Since the user has to put the baby down in the mode switching, the swift mode switching may be difficult and the use of the baby carrier may be inconvenient.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a baby carrier capable of adjusting a ratio of loads applied to a shoulder band and a waist band by swiftly switching a load-applied direction through a simple operation of a load control unit.

In accordance with an aspect of the present disclosure, a baby carrier including a body part is provided. The baby carrier includes a pair of shoulder bands coupled to opposite sides of an upper portion of the body part, a waist band coupled to a lower portion of the body part, a load control unit which is coupled to the waist band and is changed to any one posture of a first posture and a second posture to switch a load-applied direction. A ratio of loads applied to the shoulder bands and the waist band may be changed in response to the load control unit being changed from the one posture of the first posture and the second posture to the other posture of the first posture and the second posture.

The load control unit may not receive a load applied to a coupling portion of the shoulder bands and the waist band in the first posture and disperses a portion of the load applied to the shoulder bands to the waist band in the second posture.

The load control unit may include a base detachably coupled to the waist band, a hipseat hinge-coupled to the base and configured to rotate to the first posture that the hipseat is folded to the base and the second posture that the hipseat is unfolded to maintain a fixed angle to the base, and a posture maintaining unit configured to maintain a position of the hipseat in the one posture of the first posture and the second posture.

The posture maintaining unit may include a locking shaft elastically movably disposed in any one of the base and the hipseat, and a locking groove which is formed in the other one of the base and the hipseat and the locking shaft is fixedly coupled thereto.

The locking groove may include a first groove and a second groove which the locking shaft is selectively inserted thereinto and locking groove may maintain the first posture in response to the locking shaft being inserted into the first groove and maintain the second posture in response to the locking shaft being inserted into the second groove.

The first groove may be formed in an arc shape along a rotation direction of the hipseat.

A cam surface, which is inclined to a direction that a depth of the first groove is increased far away from the second groove, may be formed in the first groove.

The posture maintaining unit may include a locking shaft elastically movably disposed in the hipseat, and a locking groove which is formed in the base and the locking shaft is fixedly coupled thereto. The locking shaft may be disposed in an inner side or an outer side of the hipseat.

One end of the posture maintaining unit may be hinge-coupled to the hipseat and may maintain an unfolded state of the hipseat to the base in the second posture.

The other end of the posture maintaining unit may be detachably fixed to the hipseat in the first posture and may be held in the base in the second posture.

The posture maintaining unit may include a first snap coupling member disposed in any one of the base and the hipseat and a second snap coupling member disposed in the other one of the base and the hipseat. The first and second snap coupling members may be mutually snap-coupled in the second posture.

The first and second snap coupling members may be disposed in a portion in which the base and the hipseat are hinge-coupled.

The posture maintaining unit may include a first link of which one end is hinge-coupled to the base, and a second link of which one end is hinge-coupled to the hipseat and the other end is hinge-coupled to a portion of the first link.

The first link and the second link may be mutually snap-coupled in the second posture.

A protrusion may be formed in any one of the first link and the second link and a groove to which the protrusion is snap-coupled may be formed in the other one of the first link and the second link.

The posture maintaining unit may further include a third link of which one end is hinge-coupled to the hipseat and the other end is slidably coupled to the second link.

The third link may be disposed in a truss structure with the second link in the second posture.

The third link may overlap the second link in the first posture and the second link may overlap the first link in the first posture.

The hipseat may include a hinge part hinge-coupled to the second link and the base may include a fixing groove to which the hinge part is detachably fixed in the first posture.

The hipseat may be formed to have a structure that opposite sides thereof are inclined.

The waist band may include an engaging protrusion formed to protrude from the waist band and the load control unit may include an engaging groove detachably engaged to the engaging protrusion.

A pull handle configured to control a length may be attached to each of the shoulder bands.

The baby carrier may further include a headrest which slidably moves along a rail formed in the body part and the shoulder bands.

The baby carrier may further include a sensing unit which includes a diaper state sensing unit configured to detect a state of a diaper worn by a baby, a processor configured to determine the state of the diaper based on a signal transmitted from the diaper state sensing unit, and a communication unit configured to transmit state information of the diaper processed in the processor to an external apparatus.

The sensing unit may be disposed in a body part.

The sensing unit may further include a weight sensing unit configured to measure weight of a baby. The weight sensing unit may include an air tube disposed in an inner surface of the body part so that the baby sits on the air tube, and a pressure sensor configured to detect pressure change in the air tube in response to the weight of the baby being applied to the air tube.

The sensing unit may further include a sensor configured to measure a slope of the baby carrier.

The baby carrier may further include a distribution plate coupled to the waist band and configured to support a lower end of the base. The distribution plate may disperse a load transferred from the base.

In accordance with another aspect of the present disclosure, a baby carrier is provided. The baby carrier includes a body part, a shoulder band, a waist band coupled to a lower end of the body part, a base detachably coupled to the waist band, a hipseat hinge-coupled to the base and configured to rotate to a first posture which the hipseat is folded to the base and a second posture which the hipseat is unfolded to maintain a fixed angle to the base, and a posture maintaining unit configured to maintain a position of the hipseat in any one posture of the first posture and the second posture. The posture maintaining unit may include a locking shaft elastically movably disposed in the base, a first locking groove to which the locking shaft is fixed in the second posture, and a second locking groove which is formed in an arc shape corresponding to a rotation trajectory of the hipseat and a cam surface inclined to a direction that a depth of the second groove is increased far away from the first locking groove is formed therein.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
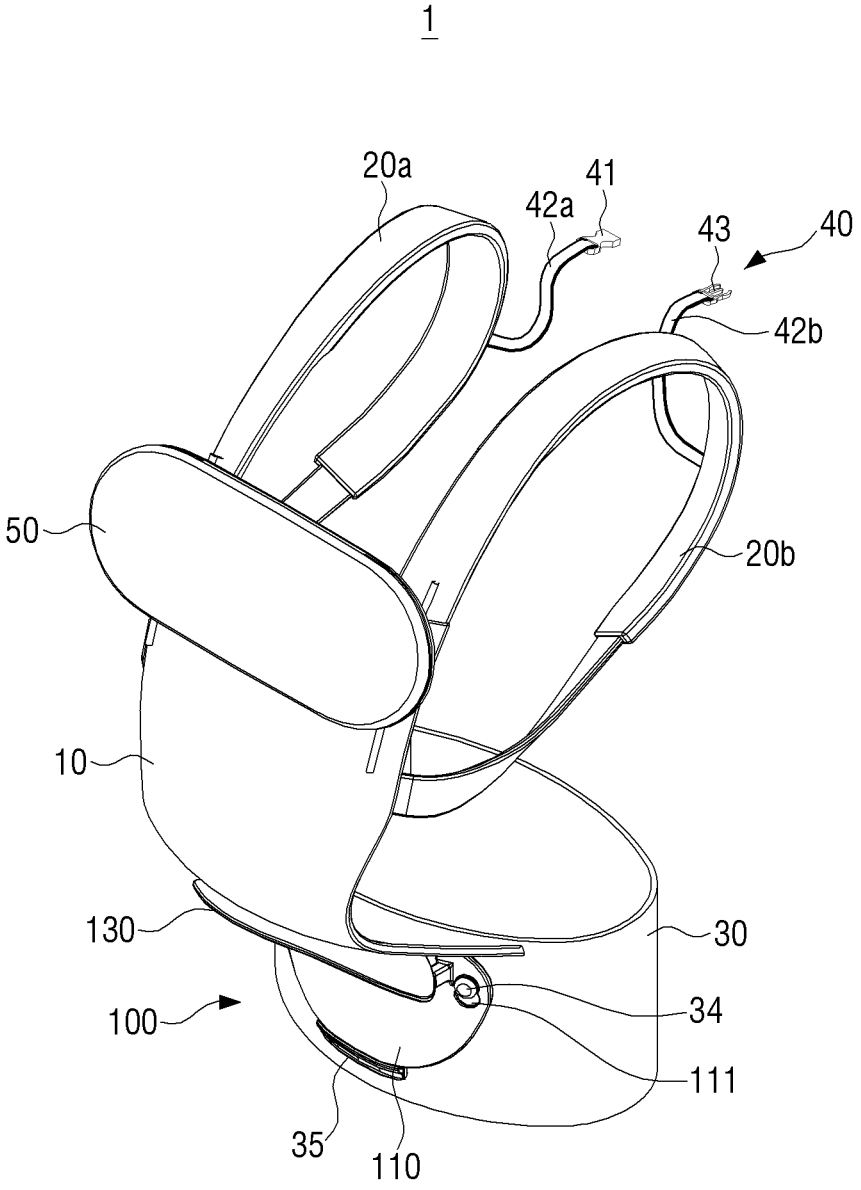
FIG. 1 is a perspective view illustrating a baby carrier according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Various embodiments will now be described more fully with reference to the accompanying drawings in which some embodiments are shown. The techniques described herein are exemplary, and should not be construed as implying any particular limitation on the present disclosure. It should be understood that various alternatives, combinations and modifications could be devised by those skilled in the art. In the following description, unless otherwise described, the same reference numerals are used for the same elements when they are depicted in different drawings.

A baby carrier 1 according to an embodiment may disperse weight of a baby, which is simultaneously transferred to left and right shoulder bands 20*a* and 20*b* and a waist band 30, in an appropriate ratio by operating a load control unit 100 in a state that a user holds a baby. Accordingly, the user may selectively control load distribution through the load control unit 100 in a state that the user holds the baby so that the pain is not concentrated on the shoulder or waist of the user due to the weight of the baby.

Hereinafter, a structure of a baby carrier according to an embodiment will be described in detail with reference to the accompanying drawings.

FIG. 1 is a perspective view illustrating a baby carrier according to an embodiment of the present disclosure.

Figure 2A:
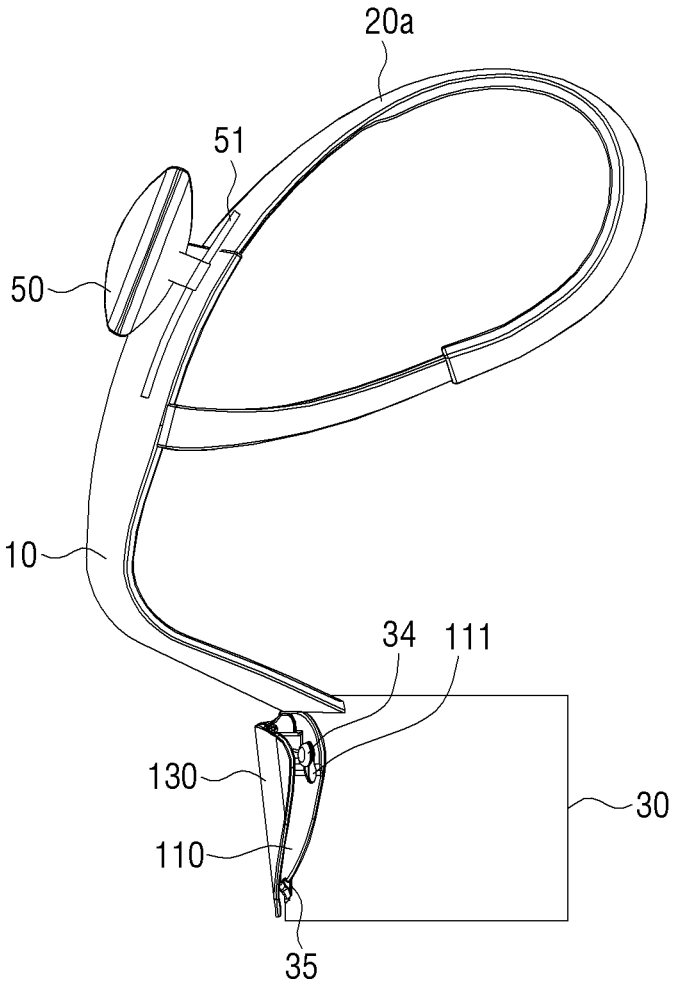
FIG. 2A is a side view illustrating an example of the baby carrier of FIG. 1 that a hipseat of a load control unit is located in a first posture according to an embodiment of the present disclosure.
Figure 2B:
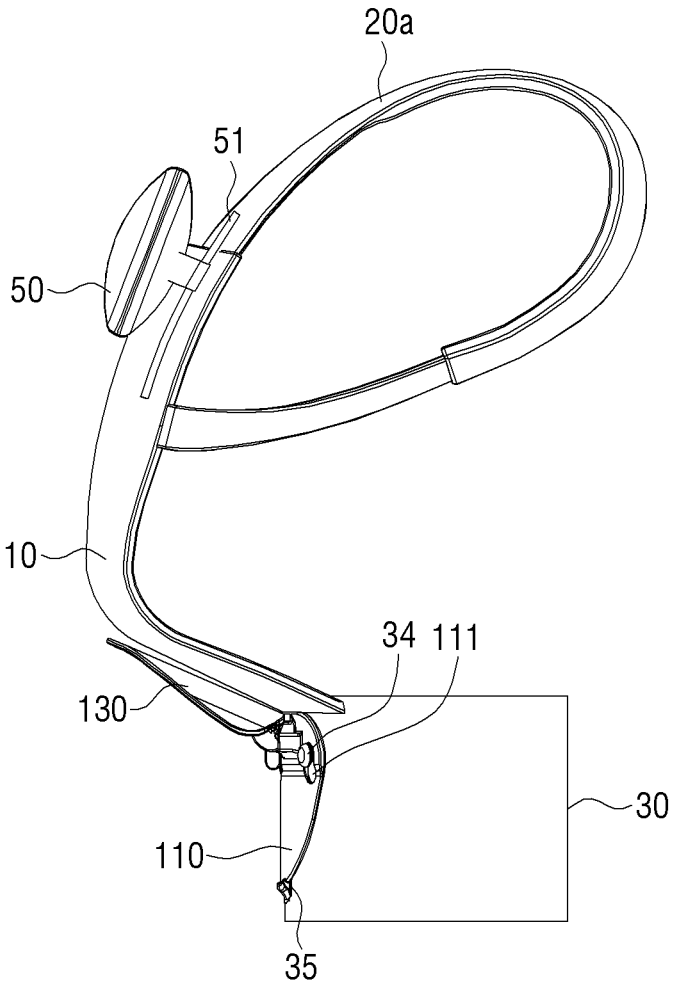
FIG. 2B is a side view illustrating an example of the baby carrier of FIG. 1 that a hipseat of a load control unit is located in a second posture according to an embodiment of the present disclosure.

FIGS. 2A and 2B are side views illustrating examples of the baby carriers that a hipseat of a load control unit is located in a first posture and a second posture according to an embodiment of the present disclosure.

Referring to FIG. 1, the baby carrier 1 according to an embodiment may include a body part 10, the left and right shoulder bands 20*a* and 20*b*, the waist band 30, a headrest 50, and the load control unit 100.

The body part 10 may support the hip and body of the baby in a state that the user holds the baby using the baby carrier 1. The left and right shoulder bands 20*a* and 20*b* may be coupled to opposite sides of an upper portion of the body part 10 and the waist band 30 may be coupled to a lower portion of the body part 10.

The left and right shoulder bands 20*a* and 20*b* may be mutually coupled through a fastening member 40 in a state that the left and right shoulder bands 20*a* and 20*b* are worn on both shoulders of the user. The fastening member 40 may include first and second belts 42*a* and 42*b* of which one ends are coupled to the left and right shoulder bands 20*a* and 20*b* and a pair of buckles 41 and 43 which are fixed to the other ends of the first and second belts 42*a* and 42*b* and are detachably snap-coupled to each other. The user may wear the left and right shoulder bands 20*a* and 20*b* on both shoulders and fasten the pair of buckles 41 and 43 of the fastening member 40 and thus the user may stably wear the baby carrier 1. The user may hold the baby in a state that the user stably wears the baby carrier 1. Accordingly, the baby may not be easily escaped from the baby carrier 1 and the accident that the baby falls down the baby carrier may be prevented in advance.

An upper end of a front of the waist band 30 may be coupled to the body part 10 and the waist band 30 may surround the waist portion of the user while the user wears the baby carrier 1. The waist band 30 may include a snap-fitting (not shown) such as the above-described buckles so that the user may easily wear and take off the baby carrier 1.

A fixing plate 31 may be coupled to an inner side of the waist band 30. The fixing plate 31 may be disposed substantially in the front of the waist band 30 so that the fixing plate 31 may be located in a lower side of the body part 10. The fixing plate 31 to which the load control unit 100 is detachably coupled may transfer the weight of the baby to the waist band 30 through the hipseat 130 to be described later in the second posture. The fixing plate 31 and the hipseat 130 may be formed of a material having fixed rigidity to support the weight of the baby. A detailed configuration of the fixing plate 31 will be described below with reference to FIGS. 3A, 3B, and 4.

The load control unit 100 may include a base 110 detachably coupled to the waist band 30, a hipseat 130 configured to rotate to the first posture that the hipseat is folded to the base 110 and the second posture that the hipseat is unfolded to maintain a fixed angle to the base 110, and a posture maintaining unit 200 configured to maintain a position of the hipseat 130 to any one of the first posture and the second posture.

The base 110 may be detachably coupled to a front surface of the waist band 30. However, this is not limited thereto and the base 110 may be fixedly coupled to the front surface of the waist band 30.

One end portion of the hipseat 130 may be rotatably hinge-coupled to an upper portion of a front surface of the base 110. A posture that the hipseat 130 is folded to the base 110 as illustrated in FIG. 2A may refer to the first posture and a posture that the hipseat 130 is unfolded to maintain a fixed angle to the base 110 as illustrated in FIG. 2B may refer to the second posture. As the load control unit 100 has the first posture and the second posture, the degree of load applied to the left and right shoulder bands 20*a* and 20*b* and the waist band 30 due to the weight of the baby may be changed.

For example, most of the weight of the baby may act on the left and right shoulder bands 20*a* and 20*b* rather than the waist band 30. Since the load applied to the shoulders of the user is larger than the load applied to the waist of the user in a state that most of the weight of the baby acts on the left and right shoulder bands 20*a* and 20*b*, the user who uses the baby carrier 1 for a long time may feel the pain in the shoulders larger than in the waist.

For example, in response to the load control unit 100 being changed to the second posture in a state that the user holds the baby, the hipseat 130 may receive the weight of the baby applied to the body part 10 and transfer the weight of the baby to the waist band 30. Accordingly, a considerable portion of the load applied to the left and right shoulder bands 20*a* and 20*b* may be dispersed to the waist band 30 and the load applied to the shoulders of the user may be alleviated.

In another example, as the user users the baby carrier for a long time in a state that the load control unit 100 is in the second posture, the user may feel the pain in the waist and the user may change the load control unit 100 to the first posture. Accordingly, the body part 10 is not supported and a considerable portion of the load applied to the waist of the user may be dispersed to the shoulders of the user.

Accordingly, the user may change the load control unit 100 to any one of the first posture and the second posture and change the ratio of the loads applied to the left and right shoulder bands 20*a* and 20*b* and the waist band 30. Accordingly, the load due to the weight of the baby may not be concentrated on any portion of the shoulders and the waist of the user and the pain in the corresponding portion may be alleviated.

Figure 3A:
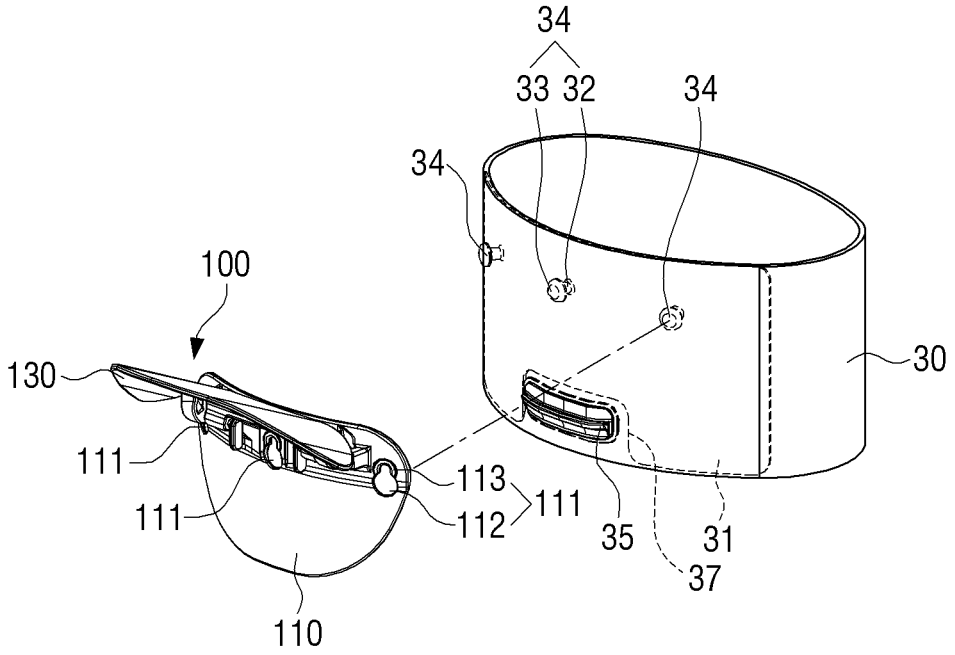
FIG. 3A is an exploded perspective view illustrating a load control unit and a waist band illustrated in FIG. 1 according to an embodiment of the present disclosure.

FIG. 3A is an exploded perspective view illustrating a load control unit and a waist band illustrated in FIG. 1 according to an embodiment of the present disclosure.

Figure 3B:
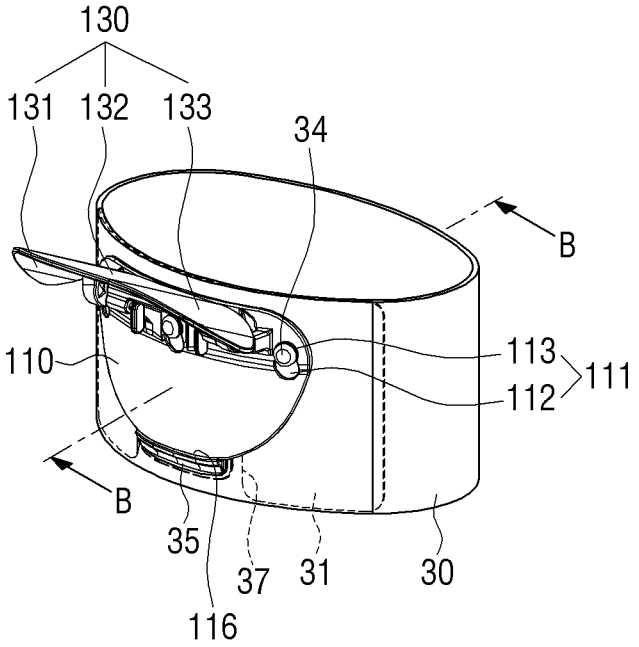
FIG. 3B is a coupling perspective view illustrating the load control unit and the waist band illustrated in FIG. 3A according to an embodiment of the present disclosure.

FIG. 3B is a coupling perspective view illustrating the load control unit and the waist band illustrated in FIG. 3A according to an embodiment of the present disclosure.

Figure 4:
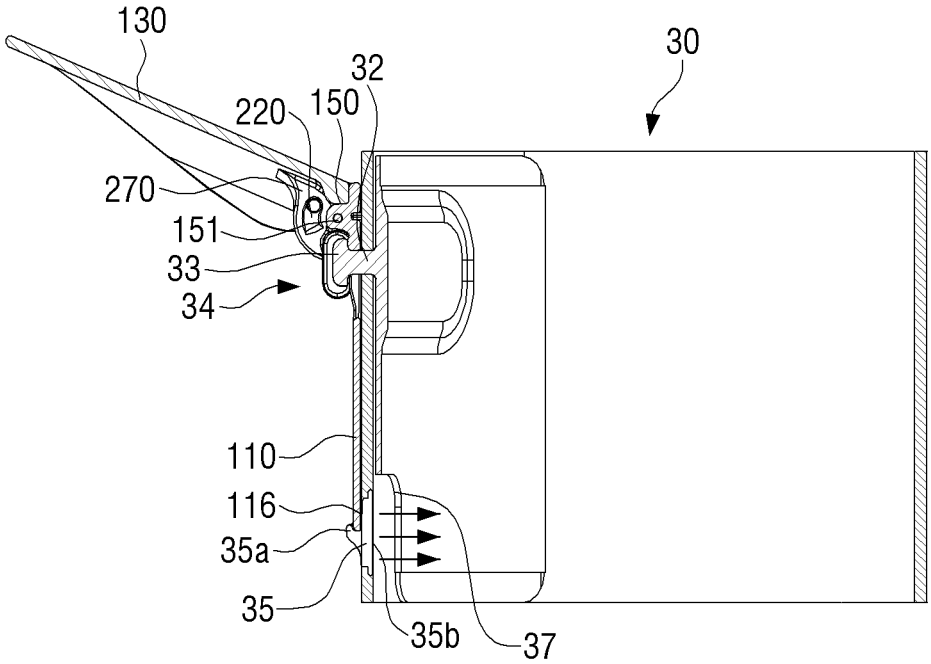
FIG. 4 is a cross-sectional diagram illustrating the load control unit and the waist band taken along line B-B of FIG. 3B according to an embodiment of the present disclosure.

FIG. 4 is a cross-sectional diagram taken along line B-B of FIG. 3B according to an embodiment of the present disclosure.

The waist band 30 may include the fixing plate 31 configured to detachably fix the load control unit 100 to the waist band 30. The fixing plate 31 may be disposed along a length direction of the waist band 30 to surround the stomach and a portion of the waist of the user in the front inner side of the waist band 30.

The fixing plate 31 may include a plurality of engaging protrusions 34 exposed to the outer side of the waist band 30 in a front surface thereof. Each of the plurality of engaging protrusions 34 may be configured of a pin portion 32 protruding from the fixing plate 31 and a head portion 33 having a larger cross-sectional area than the pin portion in a tip of the pin portion 32.

The base 110 may be detachably fixed to the waist band 30 and one end of the hipseat 130 may be rotatably hinge-coupled to the front surface of the base 110. A plurality of engaging holes 111 to which the plurality of engaging protrusions 34 of the waist band 30 are engaged may be formed in the base 110. Each of the plurality of engaging holes 111 may be formed in a form that circles having different radii vertically partially overlap each other. A circle 113 formed in an upper side of the engaging hole (or groove) 111 may be formed smaller than a lower-side circle 112 formed in a lower side of the engaging hole (or groove) 111.

The lower-side circle 112 of the engaging hole 111 may have a diameter equal to or larger than that of the head portion 33 of the engaging protrusion 34 so that the head portion 33 of the engaging protrusion 34 passes through the lower-side circuit 112. The upper-side circle 113 of the engaging hole 111 may have a diameter equal to or larger than that of the pin portion 32 of the engaging protrusion 34 so that the upper-side circle 113 of the engaging hole 111 may receive the pin portion 32 of the engaging protrusion 34.

A width of a portion in which the lower-side circle 112 and the upper-side circle 113 meet each other may be formed smaller than the diameter of the pin portion 32 of the engaging protrusion 34. Accordingly, the user may determine whether or not the base 110 is stably fixed to the fixing plate 31 through an audible click and feeling in response to the base 110 being coupled to the fixing plate 31. The engaging hole 111 may serve to prevent the base 110 coupled to the fixing plate 31 from being easily escaped.

A process of coupling the base 110 to the fixing plate 31 will be described below. The user may move the base 110 toward the front surface of the fixing plate 31, pass through the head portion 33 of the engaging protrusion 34 through the lower-side circle 112 of the engaging hole 111, and move the base 110 downward so that the pin portion 32 of the engaging protrusion 34 is engaged to the upper-side circle 113 of the engaging hole 111. A process of separating the base 110 from fixing plate 31 may be performed in reverse order of the process of coupling the base 110 to the fixing plate 31.

The base 110 may be curved to have a fixed curvature corresponding to a curve of the stomach of the user so that the base 110 may protrude toward a front that the load control unit 100 is disposed while the user wears the baby carrier 1. Accordingly, the base 110 may be in tight contact with the stomach and the portion of the waist of the user and the load transferred from the hipseat 130 in the second posture may be substantially evenly transferred to the stomach and the portion of the waist through the base 110. Accordingly, the user may feel comfortable wearing sensation while the user wears the baby carrier 1.

Inclined portions 131 and 133 inclined to a fixed angle may be formed to extend from opposite sides of a central portion 132 in the hipseat 130. Accordingly, the inclined portions 131 and 133 may smoothly support the legs of the baby in the second posture. Opposite sides of the hipseat may not protrude in the first posture and may not be in contact with the body of the baby, for example, legs or thighs.

Referring to FIG. 4, a distribution plate 35 configured to support the lower end of the base 110 may be disposed in an outer side of the waist band 30. The weight of the baby applied to the hipseat 130 in the second posture may be transferred to the base 110. Accordingly, the base 110 may be, for example, in a state to be rotated counterclockwise about the engaging protrusion 34 as a reference point. Accordingly, the lower end of the base 110 may press the front surface of the waist band 30. In this example, the load may be concentrated on a waist band 30 portion which is in contact with a corner of the lower end of the inclined base 110. To disperse the concentrated load, the distribution plate 35, of which one end 35*a* supports the lower end of the base 110 and the other end 35*b* is fixed to the waist band 30, may be disposed in an outer side of the waist band 30. The distribution plate 35 may be disposed spaced from the fixing plate 31.

The distribution plate 35 may support a portion of the base 110 which is farthest from a portion of the base 110 hinge-coupled to the hipseat 130. An concave arrangement groove 37 in which the distribution plate 35 is to be disposed may be formed in a lower end of the fixing plate 31 so that the distribution plate 35 supports a lower end 116 of the base 110. The arrangement groove 37 may be formed larger than the distribution plate 35. Accordingly, the distribution plate 35 may be disposed spaced from the fixing plate 31.

The distribution plate 35 may support a lower portion of the base 110 in response to the lower end 116 of the base 110 being inclined toward the waist band 30. Accordingly, while the lower end 116 of the base 110 may be inclined, the distribution plate 35 may prevent force from being concentrated on any one point. The distribution plate 35 may disperse the load concentrated on the corner of the inclined lower end 116 of the base 110. As indicated by an arrow in FIG. 4, the load applied to the hipseat 130 may be dispersed through the distribution plate 35 and may act on the user. Accordingly, the pain applied to the stomach of the user may be alleviated.

A posture maintaining unit 200 may be variously embodied and various embodiments of the posture maintaining unit 200 will be described with reference to the accompanying drawings.

Figure 5:
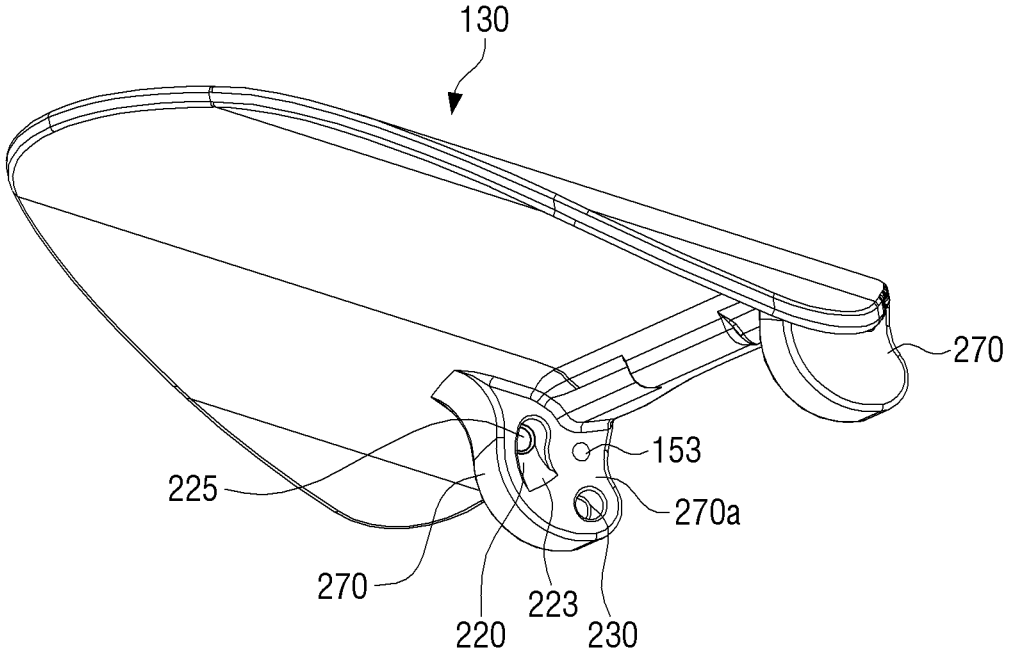
FIG. 5 is a perspective view illustrating a hipseat of a load control unit according to an embodiment of the present disclosure.

FIG. 5 is a perspective view illustrating a hipseat of a load control unit according to an embodiment of the present disclosure.

Figure 6:
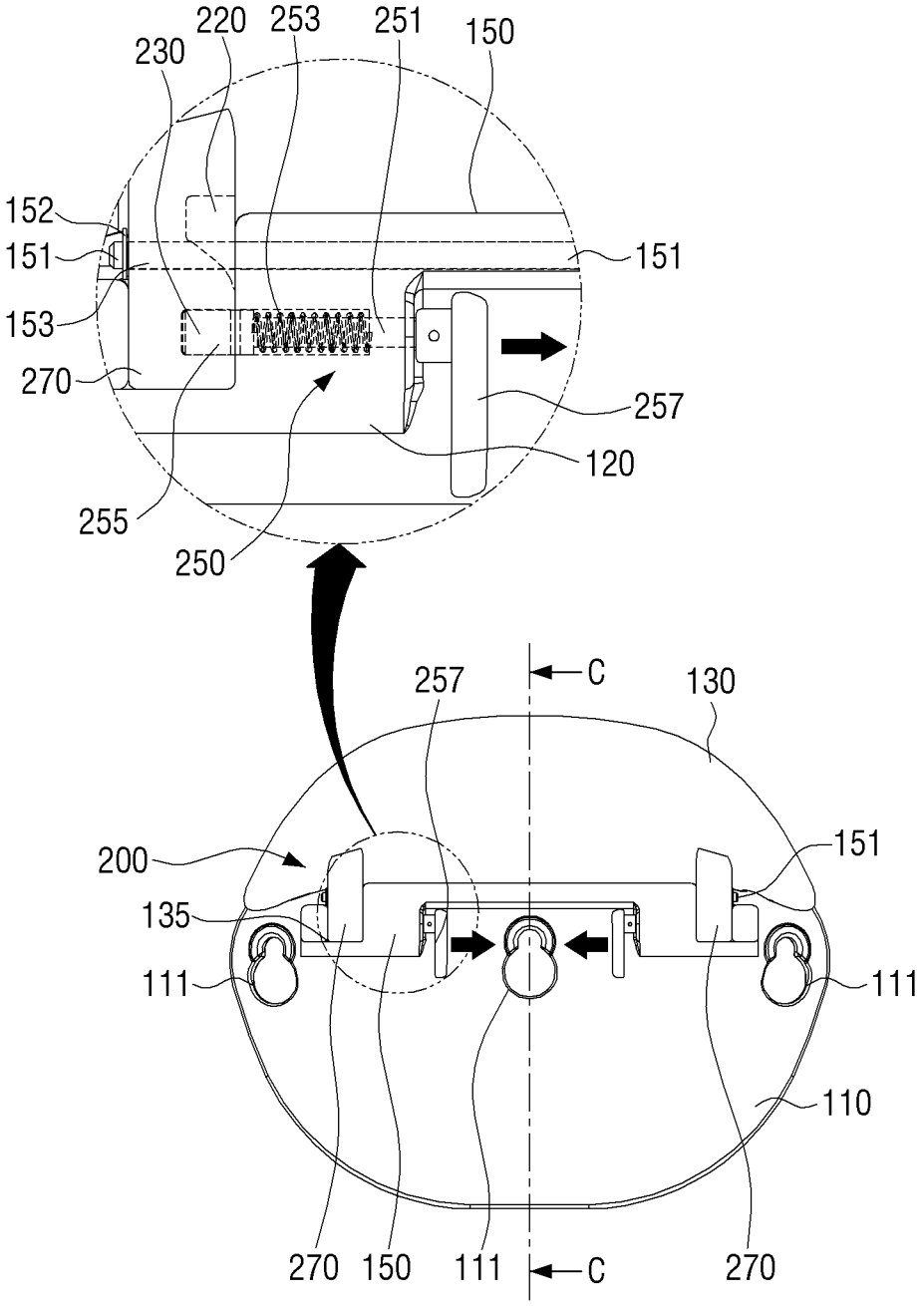
FIG. 6 is a front view illustrating a load control unit which maintains a second posture through a locking structure according to an embodiment of the present disclosure.

FIG. 6 is a front view illustrating a load control unit which maintains a second posture through a locking structure according to an embodiment of the present disclosure.

Figure 7A:
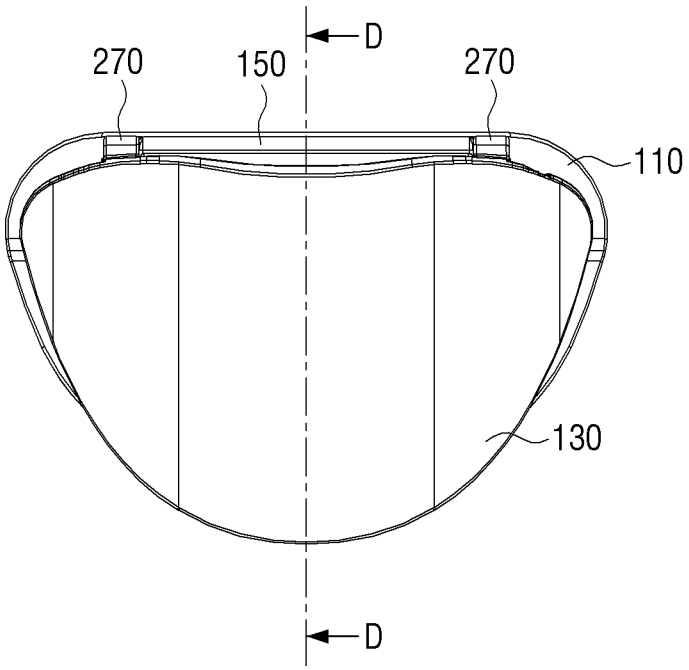
FIG. 7A is a front view illustrating a load control unit which maintains a first posture through a locking structure according to an embodiment of the present disclosure.

FIG. 7A is a front view illustrating a load control unit which maintains a first posture through a locking structure according to an embodiment of the present disclosure.

Figure 7B:
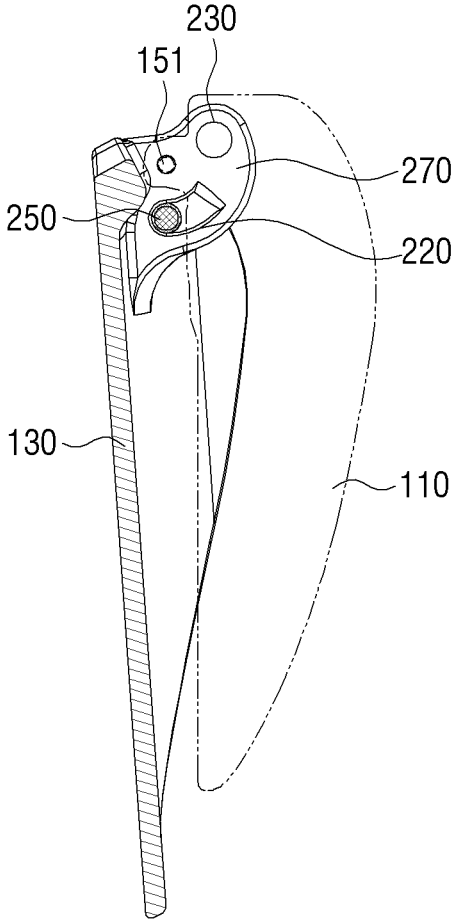
FIG. 7B is a cross-sectional diagram illustrating the load control unit taken along line D-D of FIG. 7A according to an embodiment of the present disclosure.

FIG. 7B is a cross-sectional diagram taken along line D-D of FIG. 7A according to an embodiment of the present disclosure.

Figure 7C:
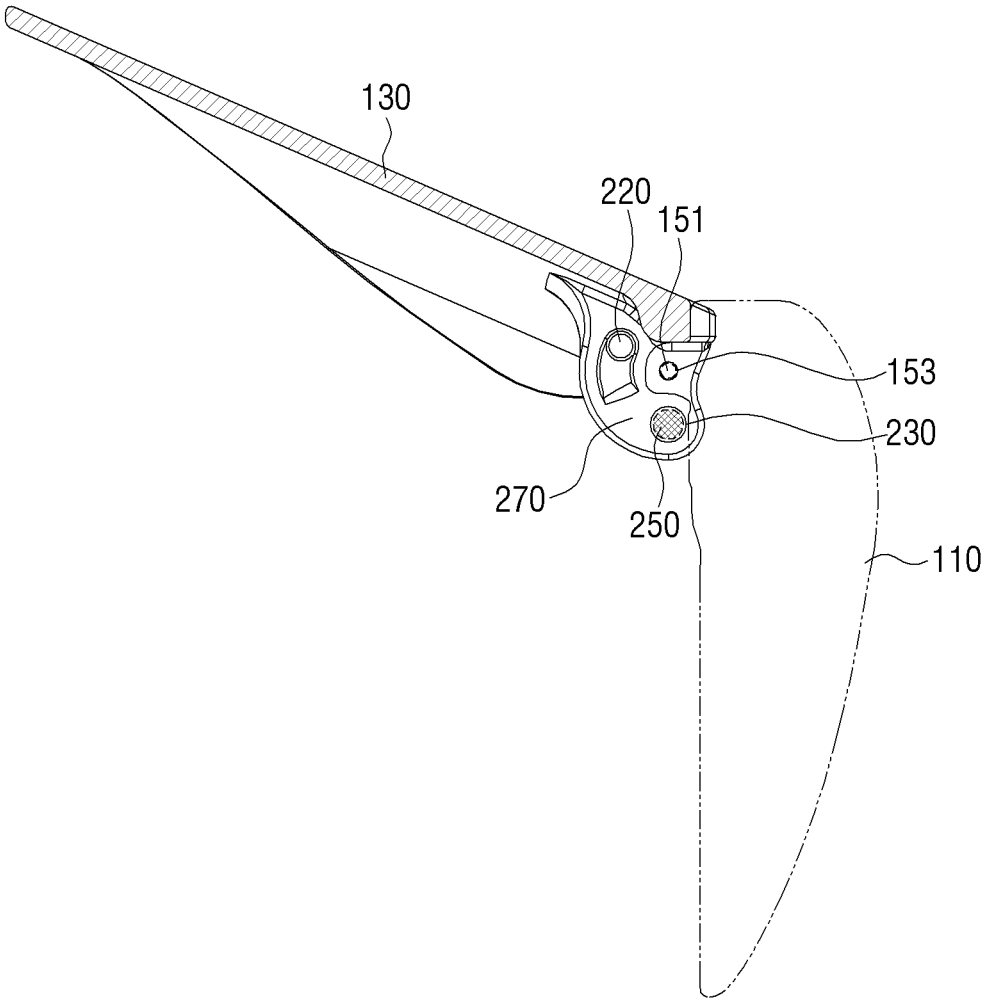
FIG. 7C is a cross-sectional diagram illustrating the load control unit taken along line C-C of FIG. 6 according to an embodiment of the present disclosure.

FIG. 7C is a cross-sectional diagram taken along line C-C of FIG. 6 according to an embodiment of the present disclosure.

Referring to FIGS. 5 to 7A, the posture maintaining unit 200 which may maintain the first posture that the hipseat 130 is folded and the second posture that the hipseat 130 is unfolded may be disposed in one side of the base 110.

The posture maintaining unit 200 may include a locking shaft 250 and a locking rib 270. The locking shaft 250 may be elastically disposed in the base 110 to be slidably movable. The posture maintaining unit 200 may be formed in the hipseat 130 and first and second locking grooves 220 and 230 to which the locking shaft 250 is fixedly coupled may be formed in the posture maintaining unit 200.

Referring to FIG. 6, the hinge part 150 may be formed to protrude in an upper portion of the front surface of the base 110 and a hinge shaft 151 configured to rotatably couple the hipseat 130 may be coupled to the base 110 (e.g., at hinge portion 540). A pair of locking ribs 270 which are disposed in opposite sides of the hinge part 150 may be formed to protrude in an upper portion of a rear surface of the hipseat 130. The pair of locking ribs 270 may be symmetrically arranged and configurations of the pair of locking ribs 270 may be the same as each other and thus only a left locking rib 270 will be described hereinafter.

Referring to FIG. 5, a hinge hole 153 and the first and second locking grooves 220 and 230 may be formed in one surface 270*a* of the locking rib 270. The hinge shaft 151 may be supported in a state that one end of the hinge shaft 151 is inserted into the hinge hole 153. Accordingly, the hipseat 130 may be rotated at a fixed angle clockwise and counter-clockwise about the base 110.

The first and second locking grooves 220 and 230 may be disposed at intervals and may be arranged in positions into which the locking shaft 250 is inserted according to the first and second postures that the hipseat 130 is folded and unfolded to the base 110. Accordingly, the locking shaft 250 may be inserted into the first locking groove 220 in the first posture that the hipseat 130 is folded to the base 110 and may be inserted into the second locking groove 230 in the second posture that the hipseat 130 is unfolded at a fixed angle to the base 110. Accordingly, the first or second posture may be maintained in response to the locking shaft 250 being inserted into the first or second locking groove 220 or 230.

The first locking groove 220 may be formed in an arc shape along a rotation direction of the hipseat 130. The first locking groove 220 may include a cam surface 223 inclined to a direction that a depth of the first locking groove 220 is increased far away from the second locking groove 230. A fixing portion 225 of the first locking groove 220 to which the locking shaft 250 may be fixed may be formed to be coupled to the cam surface 223 and may be formed in a cylindrical shape to correspond to an insertion portion 255 of the locking shaft 250 in a deepest point of the first locking groove 220. As the first locking groove 220 is formed in the arc shape, the user may change the load control unit from the first posture to the second posture only through an unfolding operation of the hipseat 130 in a state that the locking shaft 250 is inserted into the first locking groove 220 without pulling a locking handle 257.

The second locking groove 230 may be formed in a cylindrical shape corresponding to the insertion portion 255 of the locking shaft 250 to fix the locking shaft 250. A diameter of the second locking groove 230 may be formed equal to or slightly larger than that of the locking shaft 250.

The hinge coupling structure and the locking structure of the hipseat 130 and the base 110 will be described in detail.

The hipseat 130 may be hinge-coupled to the base 110 so that the hipseat 130 may rotate to the first posture that the hipseat 130 is folded to the base 110 and the second posture that the hipseat 130 is unfolded to maintain at a fixed angle to the base 110.

The hinge shaft 151 may be rotatably supported through the locking rib 270 of the hipseat 130. One end of the hinge shaft 151 may be inserted into the hinge hole 153 formed in the locking rib 270. The hipseat 130 may rotate at a fixed angle with respect to the base 110 about the hinge shaft 151 as a rotation center. The hinge shaft 151 may be disposed in the inner side of the hinge part 150, which is formed to protrude in the upper portion of the front surface of the base 110, to pass through the hinge part 150.

A rotation groove 135 may be formed in an upper portion of the base 110 so that the base 110 may not interfere with the locking rib 270 which simultaneously rotates with the hipseat 130. The posture maintaining unit 200 may include the first and second locking grooves 220 and 230 formed in the locking rib 270 and the locking shaft 250 selectively elastically coupled to the first and second locking grooves 220 and 230 in an outer side of the hinge shaft 151 or an inner side of the rotation hole (or groove) 153.

The locking shaft 250 may include a shaft portion 251, the insertion portion 255, and the locking handle 257.

The shaft portion 251 may slidably pass through the hinge part 150 and may be coupled to a portion of the hinge part 150. The insertion portion 255 may be formed to extend from one end of the shaft portion 251 and may be selectively inserted into the first and second locking grooves 220 and 230. The locking handle 257 configured to allow the user to move the shaft portion 251 may be coupled to the other end of the shaft portion 251.

As the load control unit 100 is changed to the first posture or the second posture, the insertion portion 255 may be selectively inserted into any one of the first and second locking grooves 220 and 230. In response to the insertion portion 255 being inserted into any one of the first and second locking grooves 220 and 230, the hipseat 130 located in the first or second posture may be fixed and in response to the insertion portion 255 being escaped from the first and second locking grooves 220 and 230, the hipseat 130 may be in a changeable state from one posture of the first and second postures to the other posture of the first and the second postures.

An elastic member 253 may elastically support the shaft portion 251 in the inner side of a portion of the hinge part 150. The elastic member 253 may be formed of a coil spring into which the shaft portion 251 is inserted. The elastic force of the elastic member 253 may act to a direction that the locking shaft 250 is pressed to a locking rib 270 side. Accordingly, the locking shaft 250 may linearly move along a direction substantially perpendicular to a locking rib 270 surface in which the first and second locking grooves 220 and 230 are formed.

The user may pull the locking handle 257 to a direction far away from the locking rib 270 in the second posture and the insertion portion 255 may be drawn out from the second locking groove 230. Accordingly, the unfolded state of the hipseat 130 is released and the hipseat 130 may be folded to the base 110.

A process of changing the hipseat 130 of the load control unit 100 from one posture of the first and second postures to the other posture of the first and second postures will be described with reference to FIGS. 7B and 7C.

As illustrated in FIG. 7B, the hipseat 130 may be folded to the base 110 in the first posture. For example, the weight of the baby may be put on the body part 10 of the baby carrier 1 and the left and right shoulder bands 20*a* and 20*b* may be pulled down. In this example, the load applied to the left and right shoulder bands 20*a* and 20*b* due to the weight of the baby may be larger than the load applied to the waist band 30 in the first posture.

For example, the user who uses the baby carrier 1 for a long time in a state that the load control unit 100 is set to the first posture may feel the pain in the shoulders. In this example, the user may change the load control unit 100 from the first posture to the second posture through a simple operation and accordingly, a consideration portion of the load applied to the shoulders is transferred to the waist and the pain of the shoulders may be alleviated.

To change the load control unit 100 from the first posture to the second posture, the user may simply rotate the hipseat 130 to an unfolding direction of the hipseat 130 from the base 110 and thus the fixing of the hipseat 130 in the first posture may be released.

In response to the hipseat 130 being continuously rotated to the unfolding direction of the hipseat 130 by the user, the insertion portion 255 of the locking shaft 250 may be escaped from the fixing portion 225 of the first locking groove 220, may slidably move along the cam surface 223, and may be escaped from the first locking groove 220. Then, the insertion portion 255 may slide on the one surface 270*a* of the locking rib 270 which rotates with the hipseat 130.

In response to the hipseat 130 being located in the second posture that the hipseat 130 is completely unfolded, the insertion portion 255 of the locking shaft 250 may be inserted into the second locking groove 230 as illustrated in FIG. 7C. Accordingly, the hipseat 130 may be fixed in the unfolded state.

In response to the load control unit 100 being switched from the first posture to the second posture, the weight of the baby put on the body part 10 may be transferred to the waist band 30 through the hipseat 130 and the load applied to the shoulders of the user through the left and right shoulder bands 20*a* and 20*b* may be dispersed to the waist band 30. Accordingly, the load applied to the waist band 30 may largely act on the user as compared with the load applied to the left and right shoulder bands 20*a* and 20*b*.

Accordingly, the load control unit 100 may be switched from the first posture to the second posture and thus the pain applied to the shoulder of the user may be alleviated.

For example, the user who uses the baby carrier 1 for a long time in a state that the load control unit 100 is set to the second posture may feel the pain in the waist. In this example, the waist pain may be alleviated by swiftly changing the load control unit 100 from the second posture to the first posture. Hereinafter, a process of switching the load control unit 100 from the second posture to the first posture will be described.

The user may pull the locking handle 257 to an arrow direction illustrated in FIG. 6 to change the load control unit 100 from the second posture to the first posture and thus the insertion portion 255 of the locking shaft 250 inserted into the second locking groove 230 may be escaped from the second locking groove 230. In response to the hipseat 130 being rotated to a folding direction in a state that the insertion portion 255 is escaped, the insertion portion 255 may be inserted into the first locking groove 220 along the cam surface 223 of the first locking groove 220 while the insertion portion 255 slides in a state that the one surface 270*a* of the locking rib 270 is pressed through the elastic member 253. The insertion portion 255 may continuously slide along the cam surface 223 of the first locking groove 220 and simultaneously may be inserted into the fixing portion 225 of the first locking groove 220. Accordingly, the hipseat 130 may be folded to the base 110 and the load control unit 100 may be changed to the first posture.

The load control unit according to an embodiment may include the posture maintaining unit having various structures and various embodiments of the load control unit will be described with reference to FIGS. 8 to 17C.

Referring to FIGS. 8 to 17C, the load control unit may have a basic structure similar to that of the load control unit. Accordingly, the same reference numerals are used for the same elements and the same components in FIGS. 8 to 17C.

Figure 8:
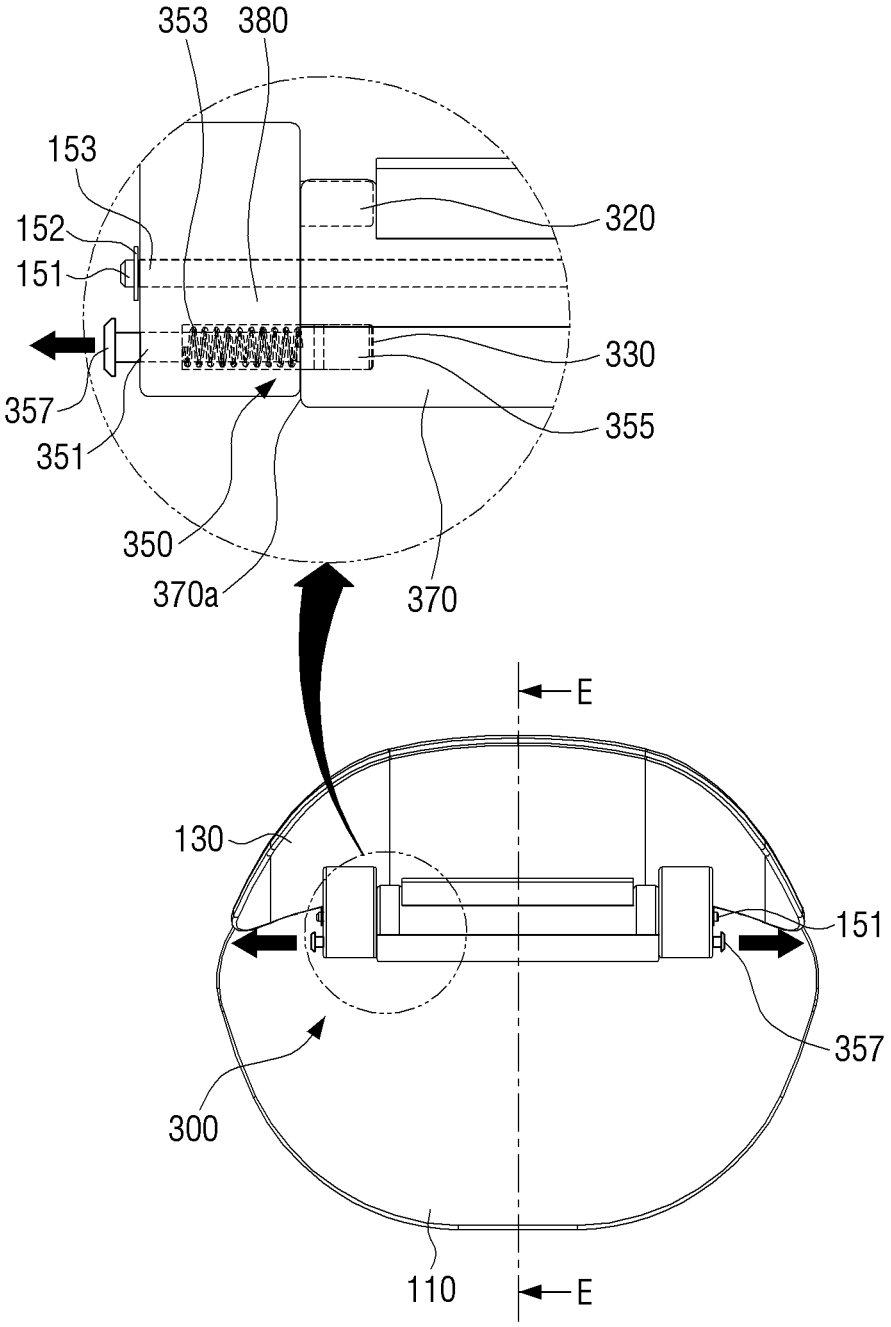
FIG. 8 is a front view illustrating a load control unit which maintains a second posture through another locking structure according to an embodiment of the present disclosure.

FIG. 8 is a front view illustrating a load control unit which maintains a second posture through another locking structure according to an embodiment of the present disclosure.

Figure 9A:
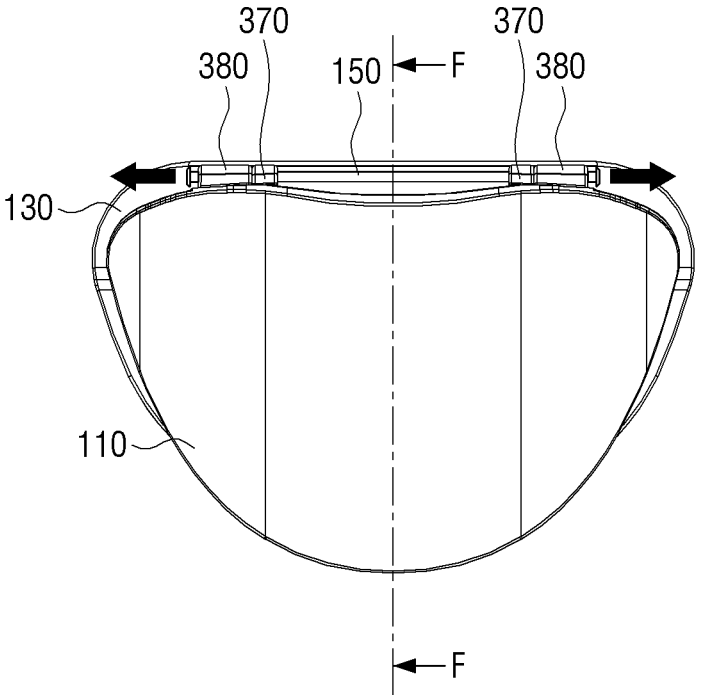
FIG. 9A is a front view illustrating a load control unit which maintains a first posture through another locking structure according to an embodiment of the present disclosure.

FIG. 9A is a front view illustrating a load control unit which maintains a first posture through another locking structure according to an embodiment of the present disclosure.

Figure 9B:
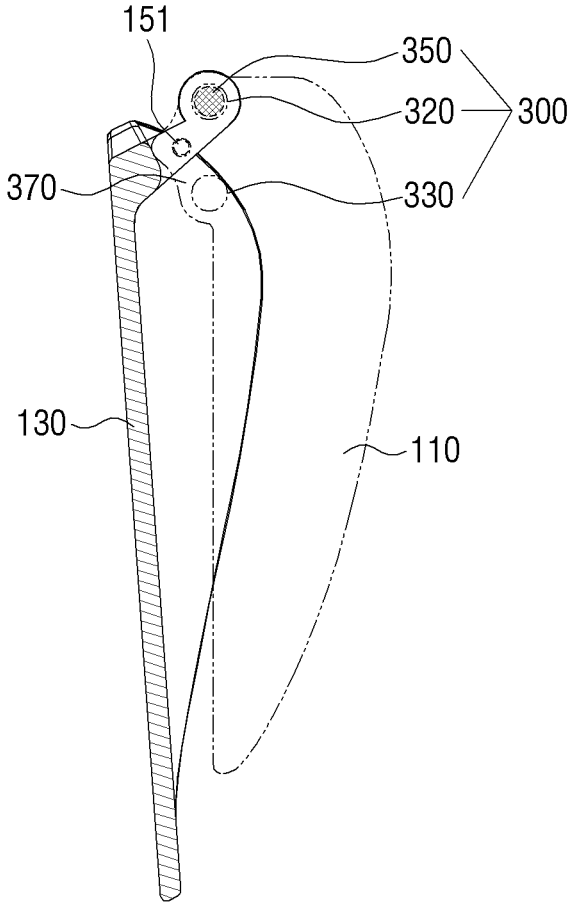
FIG. 9B is a cross-sectional diagram illustrating the load control unit taken along line F-F of FIG. 9A according to an embodiment of the present disclosure.

FIG. 9B is a cross-sectional diagram taken along line F-F of FIG. 9A according to an embodiment of the present disclosure.

Figure 9C:
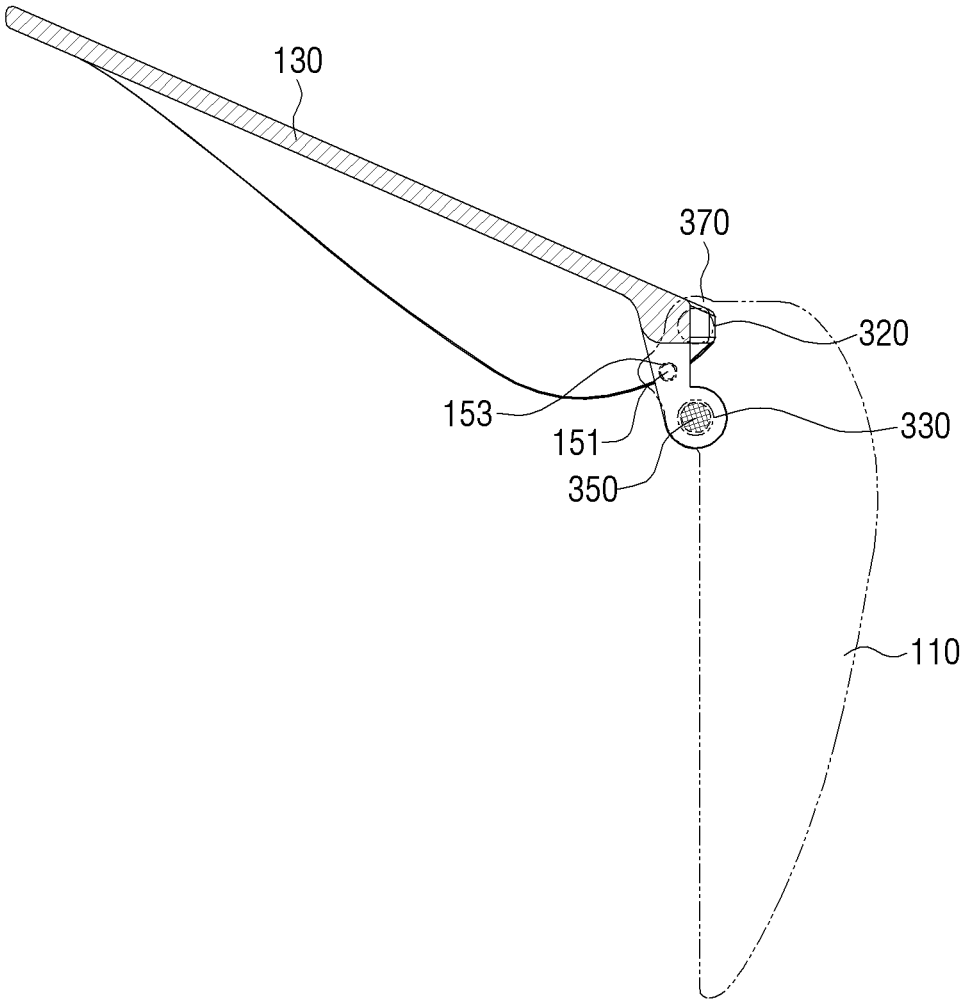
FIG. 9C is a cross-sectional diagram illustrating the load control unit taken along line E-E of FIG. 8 according to an embodiment of the present disclosure.

FIG. 9C is a cross-sectional diagram taken along line E-E of FIG. 8 according to an embodiment of the present disclosure.

Referring to FIGS. 8 to 9C, a posture maintaining unit 300 configured to operate the load control unit 100 to be switched to the first posture or the second posture may include a locking shaft 350 elastically disposed in a hipseat 130 to be slidably movable and first and second locking grooves 320 and 330 which is formed in the base 110 and the locking shaft 350 is fixedly coupled thereto.

In the load control unit 100 according to another embodiment illustrated in FIG. 8, the locking shaft 350 of the posture maintaining unit 300 may be formed in the hipseat 130 and the first and second locking grooves 320 and 330 may be formed in the base 110. The load control unit 100 in the embodiment may have the different the locking structure from the load control unit 100 of FIG. 6 that the locking shaft 250 is formed in the base 110 and the first and second locking grooves 220 and 230 are formed in the hipseat 130.

The base 110 may include a locking rib 370 in which a hinge hole 153 and the first and second locking grooves 320 and 330 are formed. The locking rib 370 may be formed to protrude toward the hipseat 130 in an upper portion of the base 110. The locking rib 370 may be formed in an outer surface of the base 110 and a pair of locking rib 370 may be symmetrically formed in opposite sides of the upper portion of the base 110.

The locking shaft 350 may linearly move along a direction perpendicular to a locking rib 370 surface. The locking shaft 350 may elastically move in a locking shaft receiving part 380 through an elastic member 353 to be described later. The locking shaft receiving part 380 may be formed in the hipseat 130 and the locking shaft receiving part 380 may be disposed close to the locking rib 370 surface.

The first locking groove 320 and the second locking groove 330 may be formed in one surface 370*a* of the locking rib at intervals. The one surface 370*a* of the locking rib may be a surface close to the locking shaft receiving part 380.

The first and second locking grooves 320 and 330 may be arranged at intervals and may be disposed in positions into which the locking shaft 350 is inserted according to the first and second postures that the hipseat 130 is folded and unfolded to the base. Accordingly, the locking shaft 350 may be inserted into the first locking groove 320 in the first posture that the hipseat 130 is folded to the base 110 and may be inserted into the second locking groove 330 in the second posture that the hipseat 130 is unfolded at a fixed angle to the base 110. Accordingly, the first or second posture may be maintained in response to the locking shaft 350 being inserted into the first or second locking groove 320 or 330.

The first locking groove 320 may be located in an upper side than the second locking groove 330.

For example, in response to the hipseat 130 being maintained in the second posture, the locking shaft 350 may be inserted into the second locking groove 330 formed in a lower side of the locking rib 370.

The first locking groove 320 and the second locking groove 330 may be formed to have a depth that an insertion portion 355 of the locking shaft 350 is inserted and fixed. The first locking groove 320 and the second locking groove 330 may be formed in a cylindrical shape corresponding to the insertion portion 355 of the locking shaft 350. The first locking groove 320 and the second locking groove 330 may be formed to have diameters equal to or slightly larger than that of the locking shaft 350.

The locking shaft 350 may include a shaft portion 351, the insertion portion 355, and a locking handle 357. The shaft portion 351 may slidably pass through a portion of the locking rib 370 and may be coupled to the locking rib 370. The insertion portion 355 may be formed to extend from one end of the shaft portion 351 and may be selectively inserted into the first and second locking grooves 320 and 330. The locking handle 357 configured to allow the user to move the shaft portion 351 may be coupled to the other end of the shaft portion 351.

The insertion portion 355 may be selectively inserted into any one of the first and second locking grooves 320 and 330 as the load control unit 100 is changed to the first posture or the second posture. In response to the insertion portion 355 being inserted into any one of the first and second locking grooves 320 and 330, the hipseat 130 located to the first posture or the second posture may be fixed and in response to the insertion portion 355 being escaped from the first and second locking groove 320 and 330, the hipseat 130 may be in a changeable state from one posture of the first and second postures to the other posture of the first and the second postures.

The elastic member 353 may elastically support the shaft portion 351 in an inner side of a portion of the locking shaft receiving part 380. The elastic member 353 may be formed of a coil spring into which the shaft portion 351 is inserted. The elastic force of the elastic member 353 may act to a direction that the locking shaft 350 is pressed to a locking rib 370 side. Accordingly, the locking shaft 350 may linearly move along a direction substantially perpendicular to the locking rib 370 surface in which the first and second locking grooves 320 and 330 are formed.

The user may pull the locking handle 357 to a direction far away from the locking rib 370 in the second posture and the insertion portion 355 may be drawn out from the second locking groove 330. Accordingly, the unfolded state of the hipseat 130 is released and the hipseat 130 may be folded to the base 110.

The locking shaft 350 may be disposed to be exposed to the outside in response to the hipseat 130 being unfolded to the second posture. The locking shaft 350 has to move to an arrow direction as illustrated in FIG. 8 to change the posture of the hipseat 130. Since the locking handle 357 is exposed to the outside in a state that the hipseat 130 is unfolded, the user may easily change the hipseat 130 from the second posture to the first posture.

In response to the load control unit 100 being changed from any one posture of the first and second postures to the other posture of the first and second postures, the insertion portion 355 may be escaped from the first locking groove 320 or the second locking groove 330. Then, the insertion portion 355 may slide on the one surface 370*a* of the locking rib 370 and simultaneously the insertion portion 355 may rotate with the hipseat 130. The elastic force may act on the insertion portion 355 to the locking rib 370 direction through the elastic member 353 and the insertion portion 355 may be inserted into the first locking groove 320 or the second locking groove 330 in response to the hipseat 130 being located in the first posture or the second posture.

For example, as illustrated in FIG. 9B, in response to the hipseat 130 being located in the first posture, the insertion portion 355 may be inserted into and fixed to the first locking groove 320 and as illustrated in FIG. 9C, in response to the hipseat 130 being located in the second posture, the insertion portion 355 may be inserted into and fixed to the second locking grooves 330.

In the first posture of the load control unit 100 according to another embodiment, the posture maintaining unit 300 may be disposed in a portion in which the base 110 and the hipseat 130 are hinge-coupled. Accordingly, the locking handle 357 may be covered with the hinge part 150 of the baby carrier 1. In response to the hinge part 150 being disposed to cover the coupling portion of the load control unit 100, the load control unit 100 may have a neat outer appearance.

In response to the load control unit 100 being maintained in the first posture, the locking shaft 350 may be inserted into the first locking groove 320. The locking shaft 350 may be inserted into the first locking groove 320 formed in an upper side of the locking rib 370 in a folded state of the hipseat 130.

The first locking groove 320 may be formed in a shape corresponding to the insertion portion 355 of the locking shaft 350 and thus the locking shaft 350 has to be escaped from the first locking groove 320 to release the locking of the hipseat 130 fixed to the first posture.

A process of changing the hipseat 130 of the load control unit 100 from one posture of the first and second postures to the other posture of the first and second postures will be described with reference to FIGS. 9B and 9C.

As illustrated in FIG. 9B, the hipseat 130 may be folded to the base 110 in the first posture. For example, the user may pull the locking shaft 350 to an arrow direction illustrated in FIG. 9A to change the load control unit 100 from the first posture to the second posture. In response to the locking handle 357 being pulled to the arrow direction, the insertion portion 355 of the locking shaft 350 may be escaped from the first locking groove 320. In response to the hipseat 130 being rotated to the unfolding direction in a state that the insertion portion 355 is escaped from the first locking groove 320, the insertion portion 355 may slide in a state that the one surface 370*a* of the locking rib 370 is pressed through the elastic member 353 and simultaneously the insertion portion 355 may be inserted into the second locking groove 330.

As illustrated in FIG. 9C, the insertion portion 355 of the locking shaft 350 may be inserted into and fixed to the second locking groove 330 in response to the hipseat 130 being located in the second posture that the hipseat 130 is completely unfolded. As the locking shaft 350 is inserted into the second locking groove 330, the hipseat 130 may be fixed to maintain the second posture.

The user may move the locking shaft 350 to the arrow direction illustrated in FIG. 8 to change the load control unit 100 from the second posture to the first posture. In response to the locking handle 357 being pulled to the arrow direction, the insertion portion 355 of the locking shaft 350 may be escaped from the second locking groove 330. In response to the hipseat 130 being rotated to the folding direction in a state that the insertion portion 355 is escaped from the second locking groove 330, the insertion portion 355 may slide in a state that the one surface 370*a* of the locking rib 370 is pressed through the elastic member 353 and simultaneously the insertion portion 355 may be inserted into the first locking groove 320.

Figure 10:
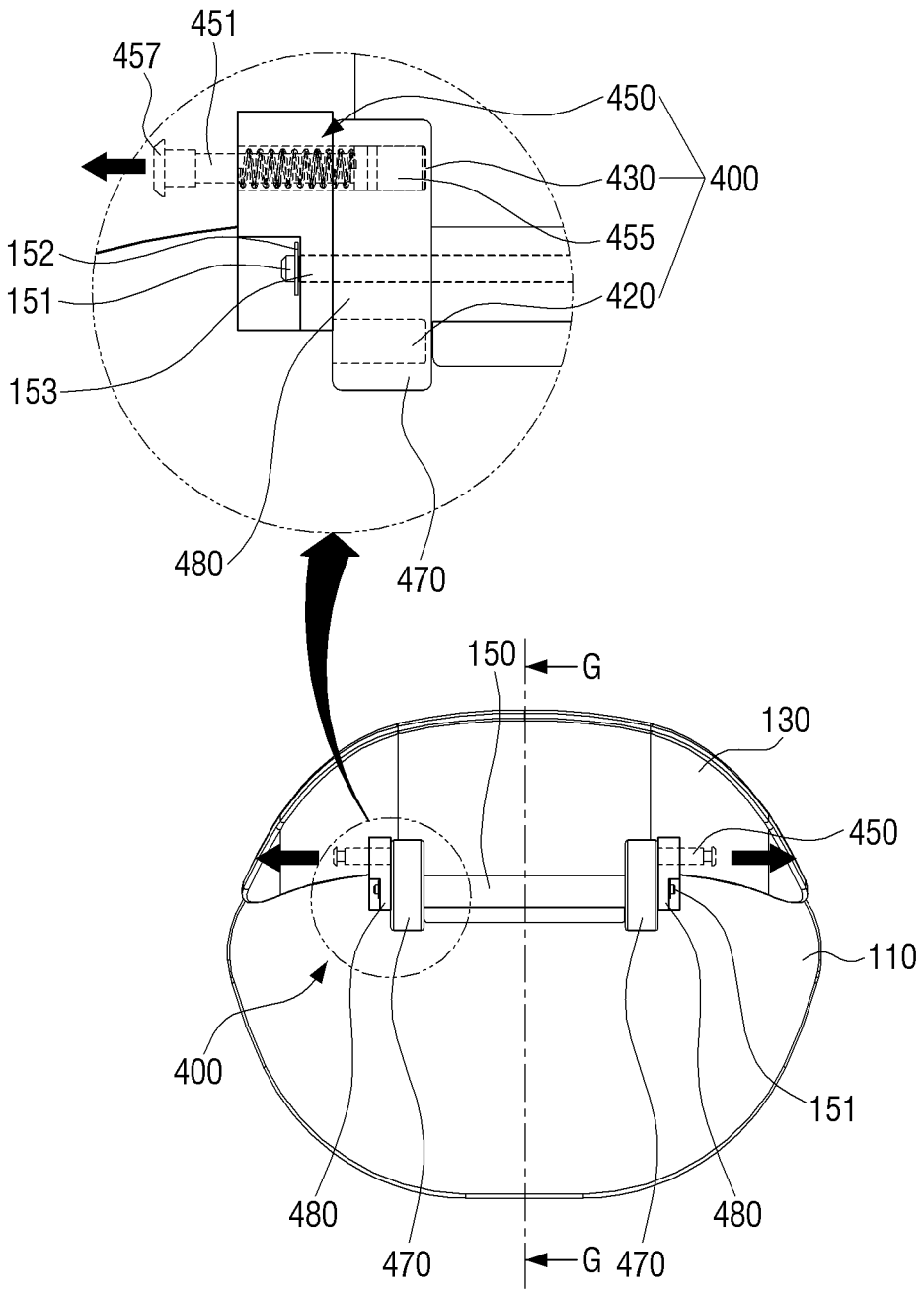
FIG. 10 is a front view illustrating a load control unit which maintains a second posture through another locking structure according to an embodiment of the present disclosure.

FIG. 10 is a front view illustrating a load control unit which maintains a second posture through another locking structure according to an embodiment of the present disclosure.

Figure 11A:
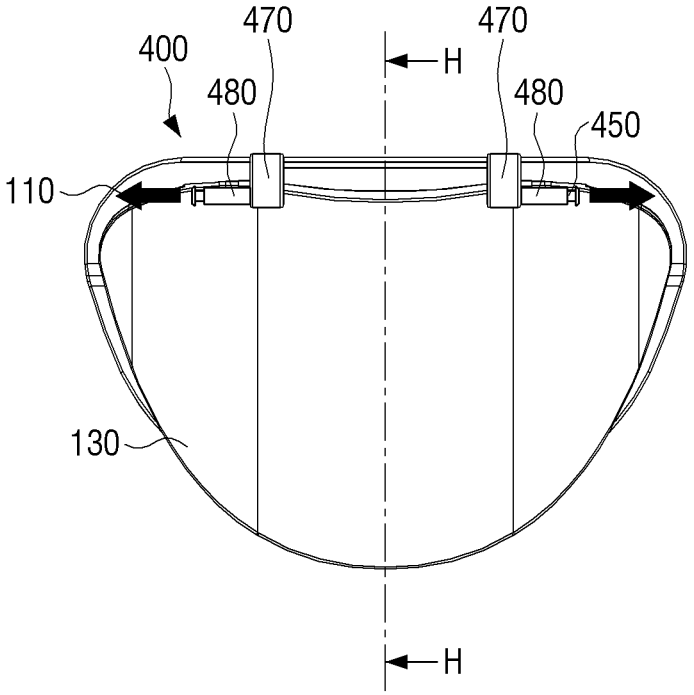
FIG. 11A is a front view illustrating a load control unit which maintains a first posture through another locking structure according to an embodiment of the present disclosure.

FIG. 11A is a front view illustrating a load control unit which maintains a first posture through another locking structure according to an embodiment of the present disclosure.

Figure 11B:
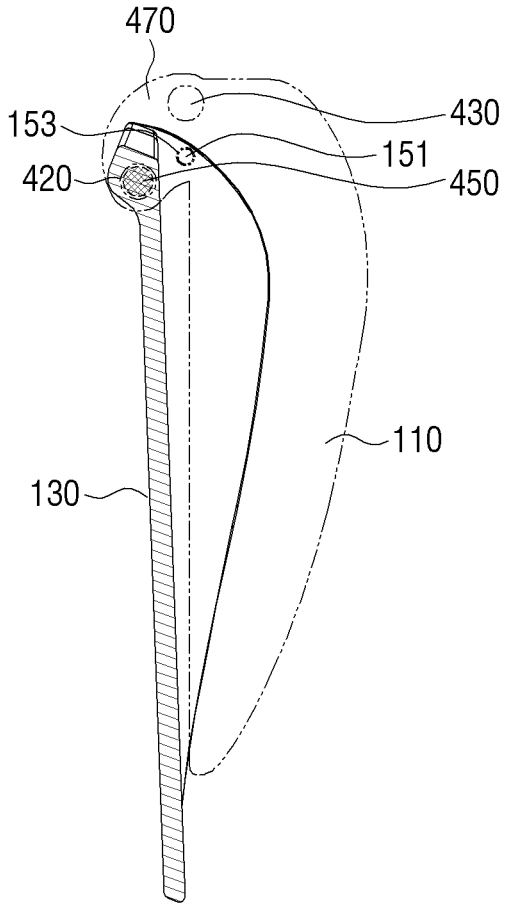
FIG. 11B is a cross-sectional diagram illustrating the load control unit taken along line H-H of FIG. 11A according to an embodiment of the present disclosure.

FIG. 11B is a cross-sectional diagram taken along line H-H of FIG. 11A according to an embodiment of the present disclosure.

Figure 11C:
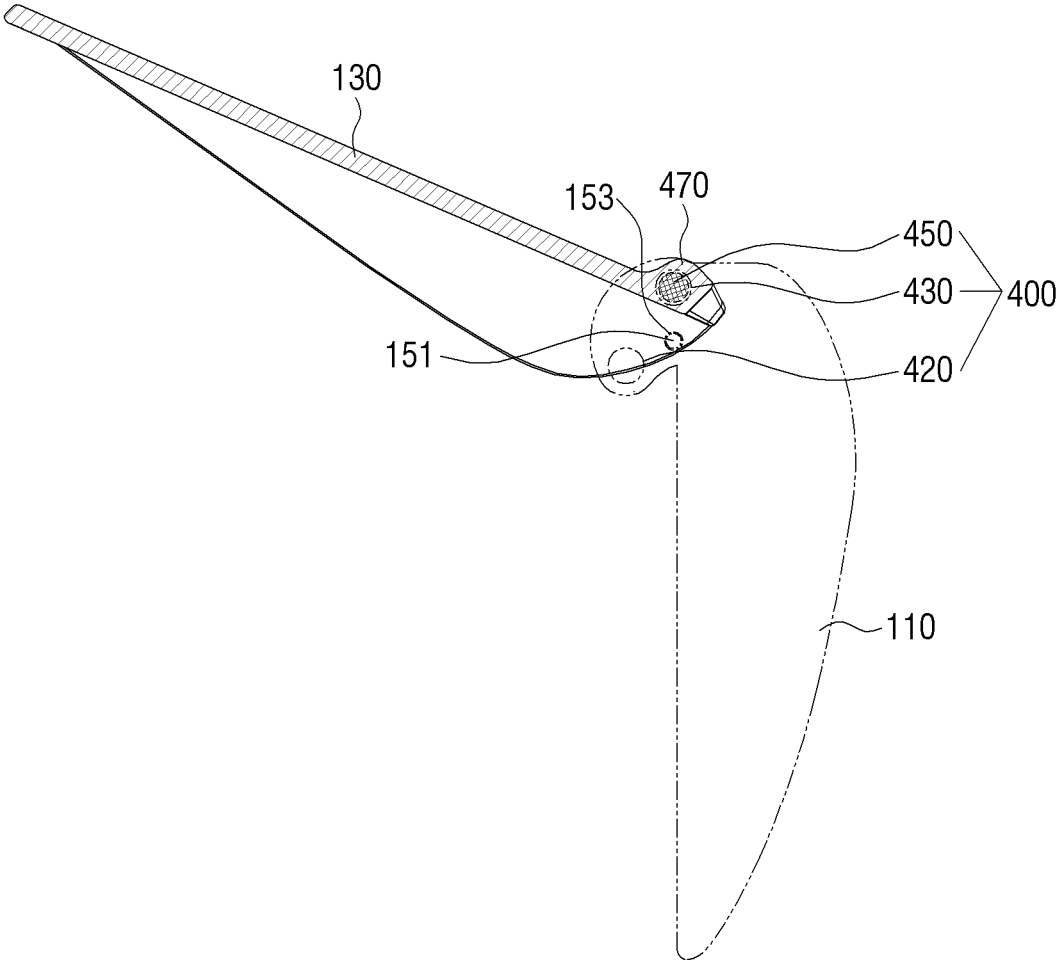
FIG. 11C is a cross-sectional diagram illustrating the load control unit taken along line G-G of FIG. 10 according to an embodiment of the present disclosure.

FIG. 11C is a cross-sectional diagram taken along line G-G of FIG. 10 according to an embodiment of the present disclosure.

Referring to FIGS. 10 to 11C, a posture maintaining unit 400 of a load control unit 100 according to another embodiment may include first and second locking grooves 420 and 430 wherein the first locking groove 420 is located in a lower side than the second locking groove 430. For example, the first locking groove 420 configured to fix the hipseat 130 to the first posture may be located in the lower side than the second locking groove 430 configured to fix the hipseat 130 to the second posture.

The load control unit having another locking structure illustrated in FIG. 10 is different from the load control unit illustrated in FIG. 8 that the first locking groove 320 is formed in an upper side than the second locking groove 330.

In response to the hipseat 130 in the load control unit 100 according to another embodiment being fixed to the second posture, a locking shaft 450 may be inserted into and fixed to the second locking groove 430 formed in an upper side than a hinge hole 153 as illustrated in FIG. 11C. Accordingly, the locking shaft 450 may not be exposed to the outside in response to the hipseat 130 being located to the second posture. The locking shaft 450 may be disposed in an outer surface of the hipseat 130. The locking shaft 450 may include a shaft portion 451, an insertion portion 455, and a locking handle 457 and may elastically move in a locking shaft receiving part 480 through.

Since the locking handle 457 is not exposed to the outside in the second posture, the risk that the fixing of the hipseat 130 in the second posture is released due to a misoperation of the user may be reduced.

In the load control unit 100 according to another embodiment, the posture maintaining unit 400 may be disposed in the outer surface of the hipseat 130 in the first posture and thus the posture maintaining unit 400 may be exposed to the outside.

In response to the load control unit 100 being maintained to the first posture, the locking shaft 450 may be inserted into the first locking groove 420 as illustrated in FIG. 11B. The locking shaft 450 may be inserted into the first locking groove 420 formed in a lower side than the hinge hole 153 of a fixing bracket 470 in the folded state of the hipseat 130.

The first locking groove 420 may be formed in a shape corresponding to the insertion portion 455 of the locking shaft 450 and thus the locking shaft 450 has to be drawn out from the first locking groove 420 to release the locking of the hipseat 130 fixed to the first posture.

The user may release the locking of the hipseat 130 fixed to the first posture by pulling the locking handle 457 to an arrow direction illustrated in FIG. 10. The locking handle 457 may be exposed to the outside in the first posture and thus the user may easily approach to the locking handle 457. Accordingly, it is convenient for the user to change the posture of the load control unit 100.

A process of changing the hipseat 130 of the load control unit 100 from any one posture of the first and second postures to the other posture of the first and second postures is the same as the process in the embodiment of FIG. 8 and thus the detailed description thereof will be omitted.

Figure 12:
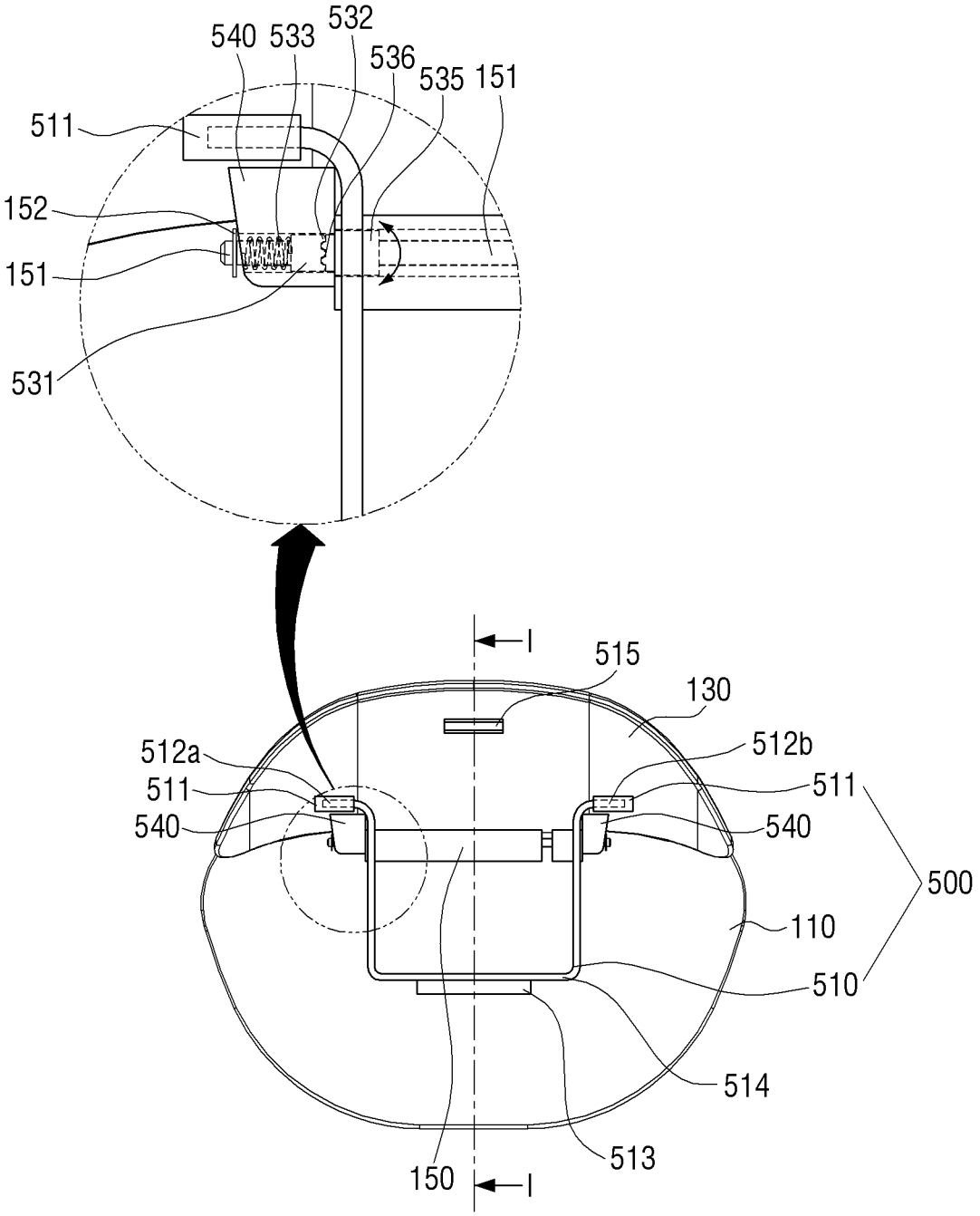
FIG. 12 is a front view illustrating a load control unit which maintains a second posture through a supporting member according to an embodiment of the present disclosure.

FIG. 12 is a front view illustrating a load control unit which maintains a second posture through a supporting member according to an embodiment of the present disclosure.

Figure 13A:
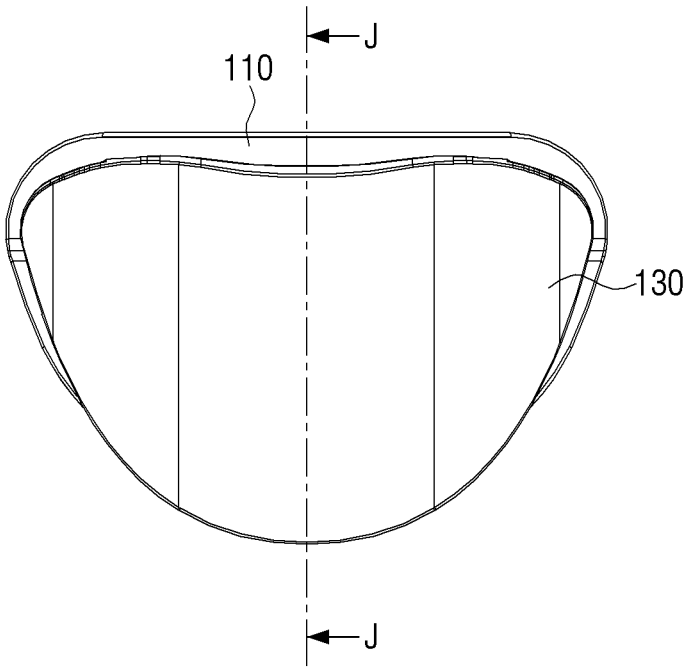
FIG. 13A is a front view illustrating a load control unit which maintains a first posture through a supporting member according to an embodiment of the present disclosure.

FIG. 13A is a front view illustrating a load control unit which maintains a first posture through a supporting member according to an embodiment of the present disclosure.

Figure 13B:
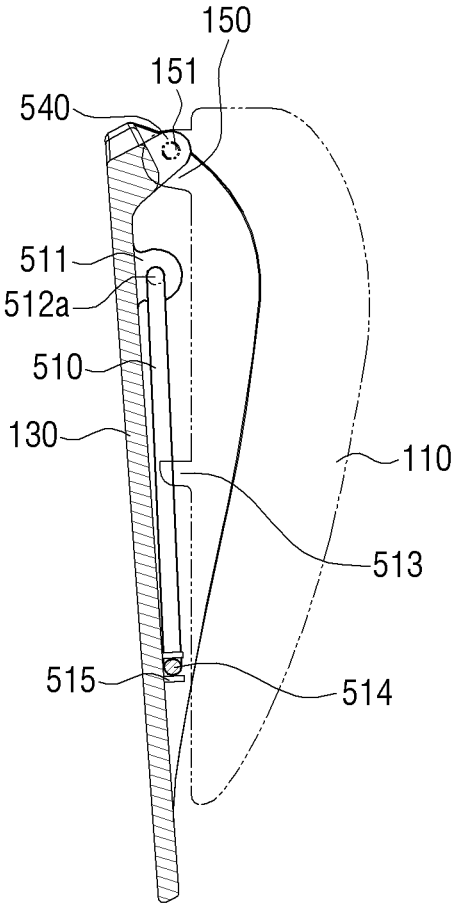
FIG. 13B is a cross-sectional diagram illustrating the load control unit taken along line J-J of FIG. 13A according to an embodiment of the present disclosure.

FIG. 13B is a cross-sectional diagram taken along line J-J of FIG. 13A according to an embodiment of the present disclosure.

Figure 13C:
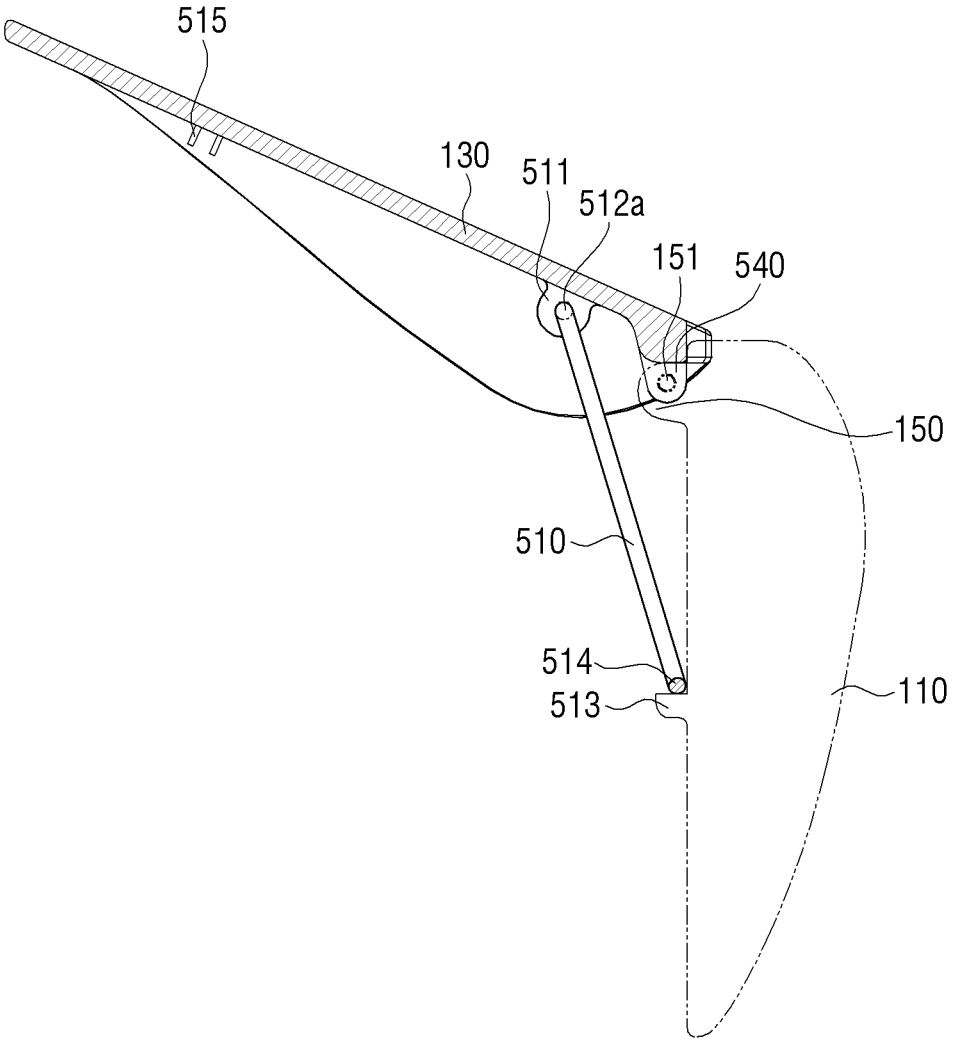
FIG. 13C is a cross-sectional diagram illustrating the load control unit taken along line I-I of FIG. 12 according to an embodiment of the present disclosure.

FIG. 13C is a cross-sectional diagram taken along line I-I of FIG. 12 according to an embodiment of the present disclosure.

Referring to FIGS. 12 to 13C, a posture maintaining unit 500 configured to control the load control unit 100 to be changed from the first or second posture in a state that the hipseat 130 is located in the second posture may be provided in one end of the base 110.

The posture maintaining unit 500 may include a supporting member 510 which one-side ends thereof are hinge-coupled to the hipseat and maintains an unfolded state of the hipseat to the base in the second posture.

One-side ends 512*a* and 512*b* of the supporting member 510 may be hinge-coupled to the hipseat 130 and the other-side end 514 of the supporting member 510 may be detachably fixed to the hipseat 130 in the first posture and may be held in the base 110 in the second posture. The support member 510 may be formed in a "ㄱ" shape and the one-side ends 512*a* and 512*b* of the supporting member 510 may be rotatably inserted into insertion grooves 511 formed in the hipseat 130. The supporting member 510 may be rotated from the unfolded hipseat 130 to the base 110. The other-side end 514 of the supporting member 510 may be held in the supporting groove 513 formed in the base 110.

The one-side ends of the supporting member 510 may be disposed in the hipseat 130 and the other-side end of the supporting member 510 may be held in the base 110 so that the hipseat 130 may be fixed in the second posture.

In response to the load control unit 100 being located in the first posture, as illustrated in FIG. 13B, the one-side ends 512*a* and 512*b* of the supporting member 510 may be hinge-coupled to the hipseat 130 and the other-side end 514 of the supporting member 510 may be detachably fixed to a receiving groove 515 formed in the hipseat 130.

In response to the load control unit 100 being located in the second posture, as illustrated in FIG. 13C, the one-side ends 512*a* and 512*b* of the supporting member 510 may be hinge-coupled to the hipseat 130 and the other-side end 514 of the supporting member 510 may be held in the supporting groove 513 formed in the base 110.

First and second snap coupling members 531 and 535 may be disposed in the hinge part 150 to which the hipseat 130 and the base 110 are hinge-coupled. The first and second snap coupling members 531 and 535 may be disposed on the hinge shaft 151. The first snap coupling member 531 may be disposed in the hipseat 130 and the second snap coupling member 535 may be disposed in the base 110. The first snap coupling member 531 and the second snap coupling member 535 may be disposed close to each other.

The first snap coupling member 531 may be disposed in a snap coupling receiving groove 515 formed in the hipseat 130 and may be disposed between an elastic member 533 and the second snap coupling member 535. The elastic member 533 may be disposed in a surface of the first snap coupling member 531 which is not close to the second snap coupling member 535. The elastic member 533 may have the elastic force to a direction that the first snap coupling member 531 presses the second snap coupling member 535. Accordingly, the first snap coupling member 531 may press the second snap coupling member 535 while the first snap coupling member is rotated with the hipseat 130. One end of the first snap coupling member 531 may be in contact with the elastic member 533 and the other end of the first snap coupling member 531 may be in contact with the second snap coupling member 535. A plurality of protrusions 532 which protrude the outer side may be formed in the other end of the first snap coupling member 531.

The second snap coupling member 535 may be disposed in a fixed state to the hinge shaft 151. The second snap coupling member 535 may be disposed in the hinge part 150 formed in the base 110. Grooves 536, which may be coupled to the protrusions 532 of the first snap coupling member 531, may be formed in the one end of the second snap coupling member 535 which is in contact with the first snap coupling member 531. The protrusions 532 and the grooves 536 may be formed to be engaged to each other in the first or second posture.

The first and second snap coupling members 531 and 535 may be snap-coupled to each other in the first or second posture. In response to the hipseat 130 being rotated in the first or second posture, the first snap coupling member 531 may be rotated through the rotation of the hipseat 130. Accordingly, the coupling of the first and second snap coupling members 531 and 535 may be released. In response to the rotating hipseat 130 being located to the first or second posture again, the first and second snap coupling members 531 and 535 may be snap-coupled to each other.

In response to the hipseat 130 being changed from the first posture to the second posture, the first snap coupling member 531 may be rotated with the hipseat 130 according to the rotation of the hipseat 130. The first and second snap coupling members 531 and 535 may be snap-coupled to each other in the first posture state of the hipseat 130, but the protrusions 532 of the first snap coupling member 531 and the grooves 536 of the second snap coupling member 535 may not be coupled to each other in response to the first snap coupling member 531 being rotated. Accordingly, the first snap coupling member 531 may linearly move to a direction opposite to a surface of the first snap coupling member 531 close to the second snap coupling member 535. For example, the first snap coupling member 531 may move to a direction in which the elastic member 533 is disposed. In response to the hipseat 130 being located in the second posture, the first and second snap coupling members 531 and 535 may be snap-coupled to each other.

A process of changing the hipseat 130 of the load control unit 100 from any one posture of the first and second postures to the other posture of the first and second postures will be described with reference to FIGS. 13B and 13C.

To change the hipseat 130 of the load control unit 100 from the first posture to the second posture, the user may simply rotate the hipseat 130 to the unfolding direction and thus the fixing to the hipseat 130 in the first posture may be released.

In response to the hipseat 130 being located in the second posture, the first and second snap coupling members 531 and 535 may be snap-coupled to each other and the hipseat 130 may be temporarily fixed to a position of the second posture. The user may separate the other-side end 514 of the supporting member 510 from the hipseat 130 and may hold the other-side end 514 of the supporting member 510 in the supporting grove 513 of the base 110. Accordingly, the other-side end 514 of the supporting member 510 is held in the base 110 and the hipseat 130 may be fixed to the second posture. The supporting member 510 may support the hipseat 130 in the second posture.

In response to the load control unit 100 being changed from the second posture to the first posture, the user may separate the other-side end 514 of the supporting member 510 held in the base 110 from the supporting groove 513 and may fix the other-side end 514 of the supporting member 510 to the receiving groove 515 of the hipseat 130. The user may move the other-side end 514 of the supporting member 510 to the hipseat 130 and may release the locking of the hipseat 130 fixed to the second posture. The locking-released hipseat 130 may be folded to the first posture.

In response to the hipseat 130 being located in the first posture, the first and second snap coupling members 531 and 535 may be snap-coupled to each other and the hipseat 130 may be temporarily fixed to the position of the first posture. The fixing force by the first and second snap coupling members 531 and 535 may have a magnitude sufficient to release the fixing in response to the hipseat 130 being unfolded through the hand of the user.

Figure 14:
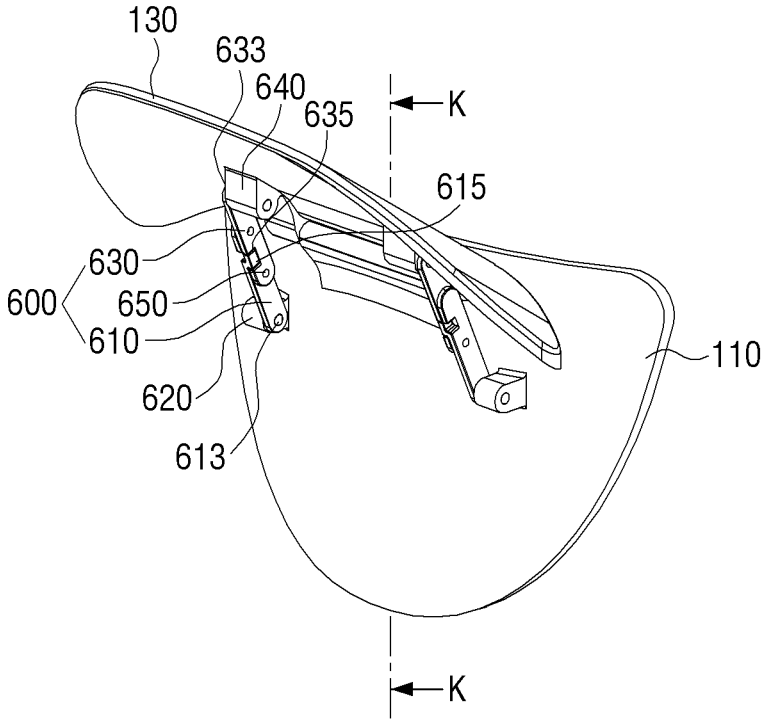
FIG. 14 is a perspective view illustrating a load control unit which maintains a second posture through a supporting member having another structure according to an embodiment of the present disclosure.

FIG. 14 is a perspective view illustrating a load control unit which maintains a second posture through a supporting member having another structure according to an embodiment of the present disclosure.

Figure 15A:
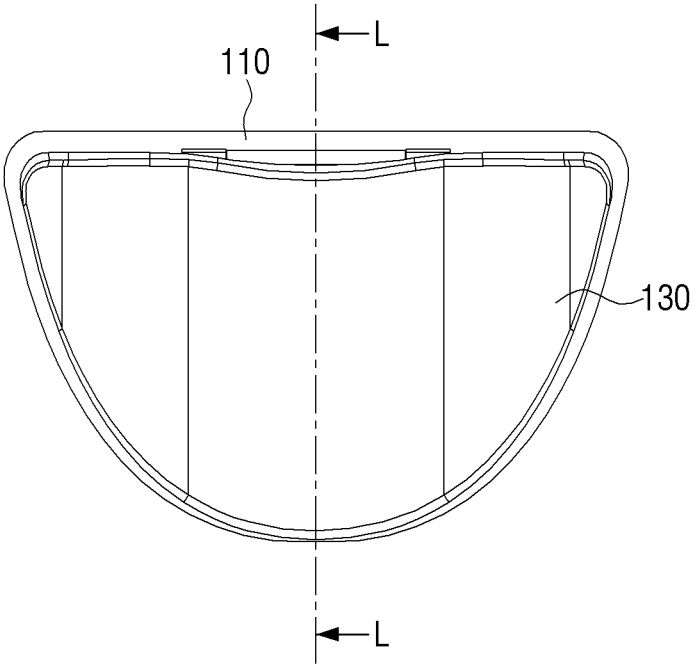
FIG. 15A is a front view illustrating a load control unit which maintains a first posture through a supporting member having another structure according to an embodiment of the present disclosure.

FIG. 15A is a front view illustrating a load control unit which maintains a first posture through a supporting member having another structure according to an embodiment of the present disclosure.

Figure 15B:
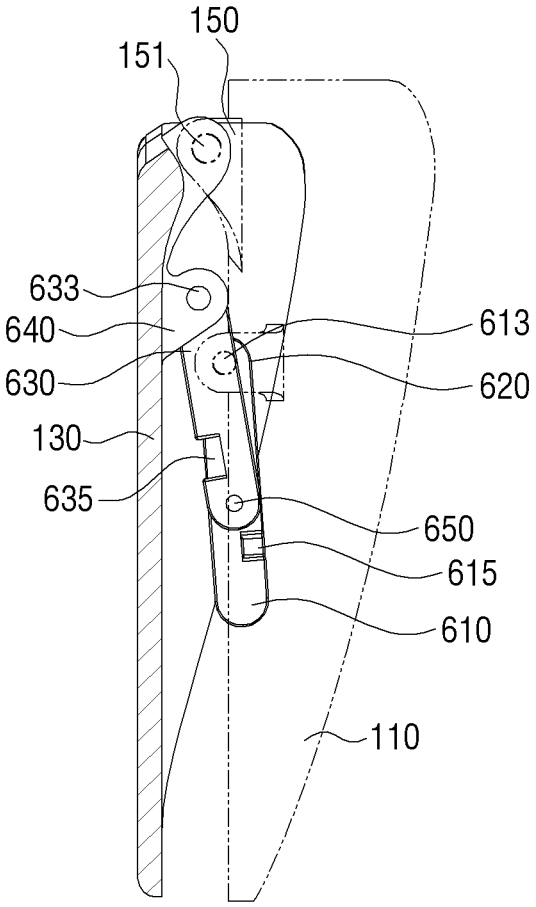
FIG. 15B is a cross-sectional diagram illustrating the load control unit taken along line L-L of FIG. 15A according to an embodiment of the present disclosure.

FIG. 15B is a cross-sectional diagram taken along line L-L of FIG. 15A according to an embodiment of the present disclosure.

Figure 15C:
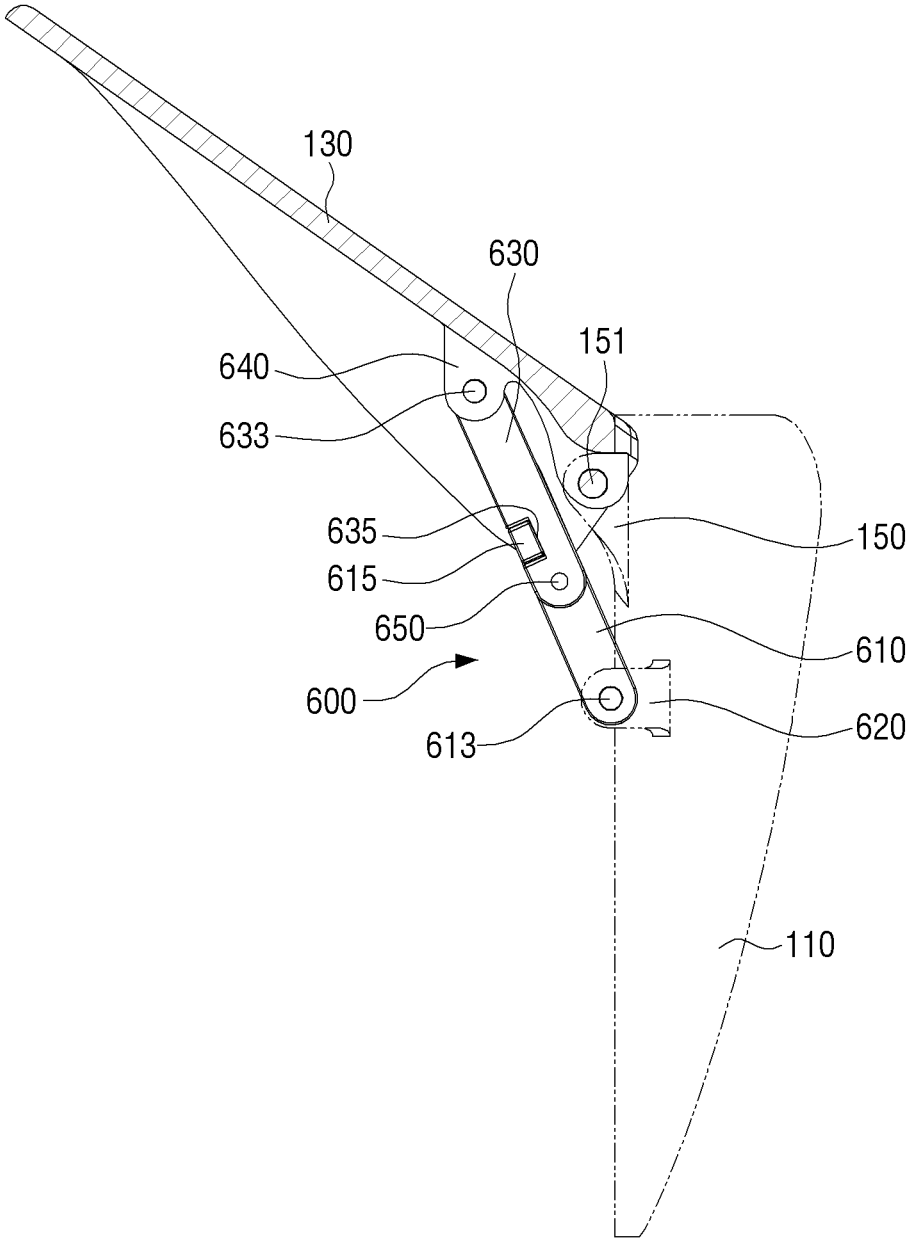
FIG. 15C is a cross-sectional diagram illustrating the load control unit taken along line K-K of FIG. 14 according to an embodiment of the present disclosure.

FIG. 15C is a cross-sectional diagram taken along line K-K of FIG. 14 according to an embodiment of the present disclosure.

Referring to FIGS. 14 to 15C, a posture maintaining unit 600 of the load control unit 100 according to another embodiment may include a supporting member configured of a first link 610 of which one end is hinge-coupled to the base 110 and a second link 630 of which one end is hinge-coupled to the hipseat 130 and the other end is hinge-coupled to a portion of the first link 610.

A hinge first shaft 613 which is rotatably coupled to the base 110 (e.g., at hinge portion 620) may be disposed in the one end of the first link 610 and a third hinge shaft 650 configured to rotatably couple the first link 610 and the second link 630 may be disposed in a central portion of the first link 610. A protrusion 615 snap-coupled with the second link 630 in the second posture may be formed in a portion of the first link 610. The protrusion 615 of the first link 610 may be formed in an upper side than the third hinge shaft 650.

A second hinge shaft 633 which is rotatably coupled to the hipseat 130 (e.g., at hinge portion 640) may be disposed in the one end of the second link 630 and the third hinge shaft 650 configured to rotatably couple the first link 610 and the second link 630 may be disposed in a central portion of the second link 630. A groove 635 snap-coupled with the first link 610 in the second posture may be formed in a portion of the second link 630. The groove 635 of the second link 630 may be formed in a lower side than the third hinge shaft 650.

The third hinge shaft 650 may rotatably couple the first link 610 and the second link 630. The first link 610 and the second link 630 may be rotated in association with each other through the third hinge shaft 650.

The first link 610 and the second link 630 may be snap-coupled to each other in the second posture. The first link 610 and the second link 630 may partially overlap each other and may be arranged on a straight line in the second posture. The hipseat 130 may be supported so as not to be folded in a position of the second posture through the first link 610 and the second link 630 arranged on the straight line.

In response to the load control unit 100 being changed from the first posture to the second posture, the user may unfold the hipseat 130 to be located in the position of the second posture. The first and second links 610 and 630 may be snap-coupled to each other so that the hipseat 130 may be fixed to the position of the second posture.

In response to the load control unit 100 being located in the first posture, the first and second links 610 and 630 may be folded to overlap each other.

In response to the load control unit 100 being changed from the second posture to the first posture, the first and second links 610 and 630 may be rotated to a direction that a coupling portion of the first and second links 610 and 630 by the third hinge shaft 650 is far away from the base 110. The first link 610 may be folded so that the third hinge shaft 650 coupled to the second link 630 is located in a lower side than the first hinge shaft 613 coupled to the base 110. The second link 630 may be folded so that the third hinge shaft 650 coupled to the first link 610 is located in a lower side than the second hinge shaft 633 coupled to the hipseat 130.

The user may apply the force to the third hinge shaft 650 portion to which the first link 610 and the second link 630 are coupled to a direction far away from the base 110 and thus may release the locking of the hipseat 130 fixed to the second posture. The locking-released hipseat 130 may be folded to the base 110 while the first and second links 610 and 630 are folded to overlap each other.

As the first and second links 610 and 630 are folded to overlap each other, the hipseat 130 and the base 110 may be folded in a compact manner.

A process of changing the hipseat 130 of the load control unit 100 from any one posture of the first and second postures to the other posture of the first and second postures will be described with reference to FIGS. 15B and 15C.

The hipseat 130 may be folded to the base 110 in response to the load control unit 100 being located in the first posture. The hipseat 130 may overlap the whole base 110 or at least a portion of the base 110 in the response to the load control unit 100 being located in the first posture.

The user may simply rotate the hipseat 130 to the unfolding direction to change the hipseat 130 of the load control unit 100 from the first posture to the second posture and thus the fixing to the hipseat 130 in the first posture may be released. In response to the hipseat 130 being unfolded by the user, the first and second links 610 and 630 may be rotated between the hipseat 130 and the base 110 and the first and second links 610 and 630 may be arranged on the straight line. For example, the first link 610 may rotate and move to the unfolding direction of the hipseat 130 and the second link 630 may rotate and move to a direction opposite to the unfolding direction of the hipseat 130. In response to the first link 610 and the second link 630 being arranged on the straight line, the protrusion 615 of the first link 610 may be snap-coupled to the groove 635 of the second link 630. As the first and second links 610 and 630 are snap-coupled, the hipseat 130 may be fixed to maintain the second posture.

The user may release the snap-coupling of the first link 610 and the second link 630 to change the load control unit 100 from the second posture to the first posture. The snap-coupling-released first link 610 may be rotated to a rotation direction that the hipseat 130 is rotated to the first posture and the second link 630 may be rotated to a direction opposite to the rotation direction of the hipseat 130. As illustrated in FIG. 15B, the first and second links 610 and 630 may be rotated so that the first and second links 610 and 630 are arranged to overlap each other.

Figure 16:
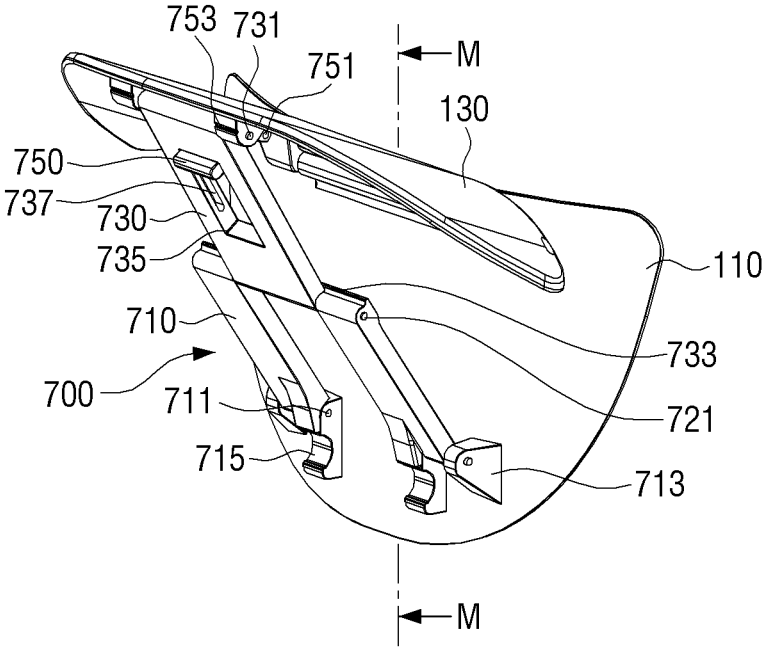
FIG. 16 is a perspective view illustrating a load control unit which maintains a second posture through a supporting member having another structure according to an embodiment of the present disclosure.

FIG. 16 is a perspective view illustrating a load control unit which maintains a second posture through a supporting member having another structure according to an embodiment of the present disclosure.

Figure 17A:
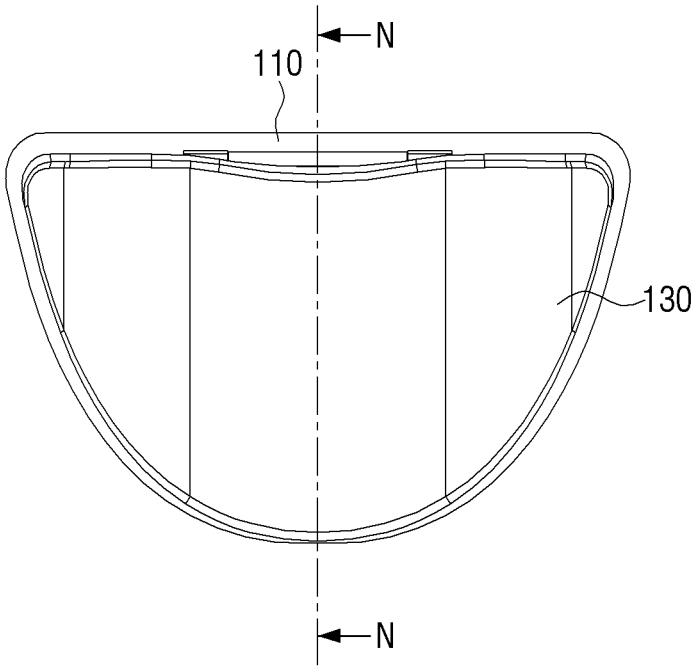
FIG. 17A is a front view illustrating a load control unit which maintains a first posture through a supporting member having another structure according to an embodiment of the present disclosure.

FIG. 17A is a front view illustrating a load control unit which maintains a first posture through a supporting member having another structure according to an embodiment of the present disclosure.

Figure 17B:
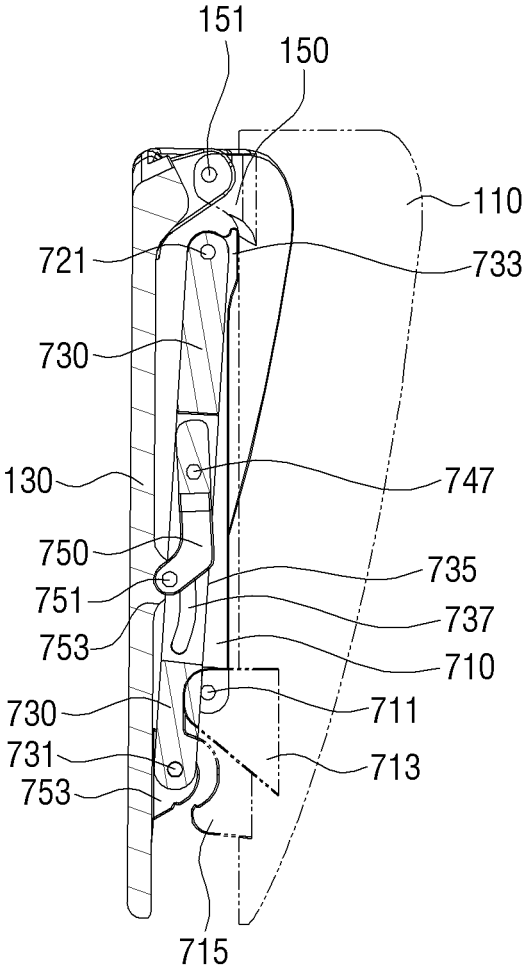
FIG. 17B is a cross-sectional diagram illustrating the load control unit taken along line N-N of FIG. 17A according to an embodiment of the present disclosure.

FIG. 17B is a cross-sectional diagram taken along line N-N of FIG. 17A according to an embodiment of the present disclosure.

Figure 17C:
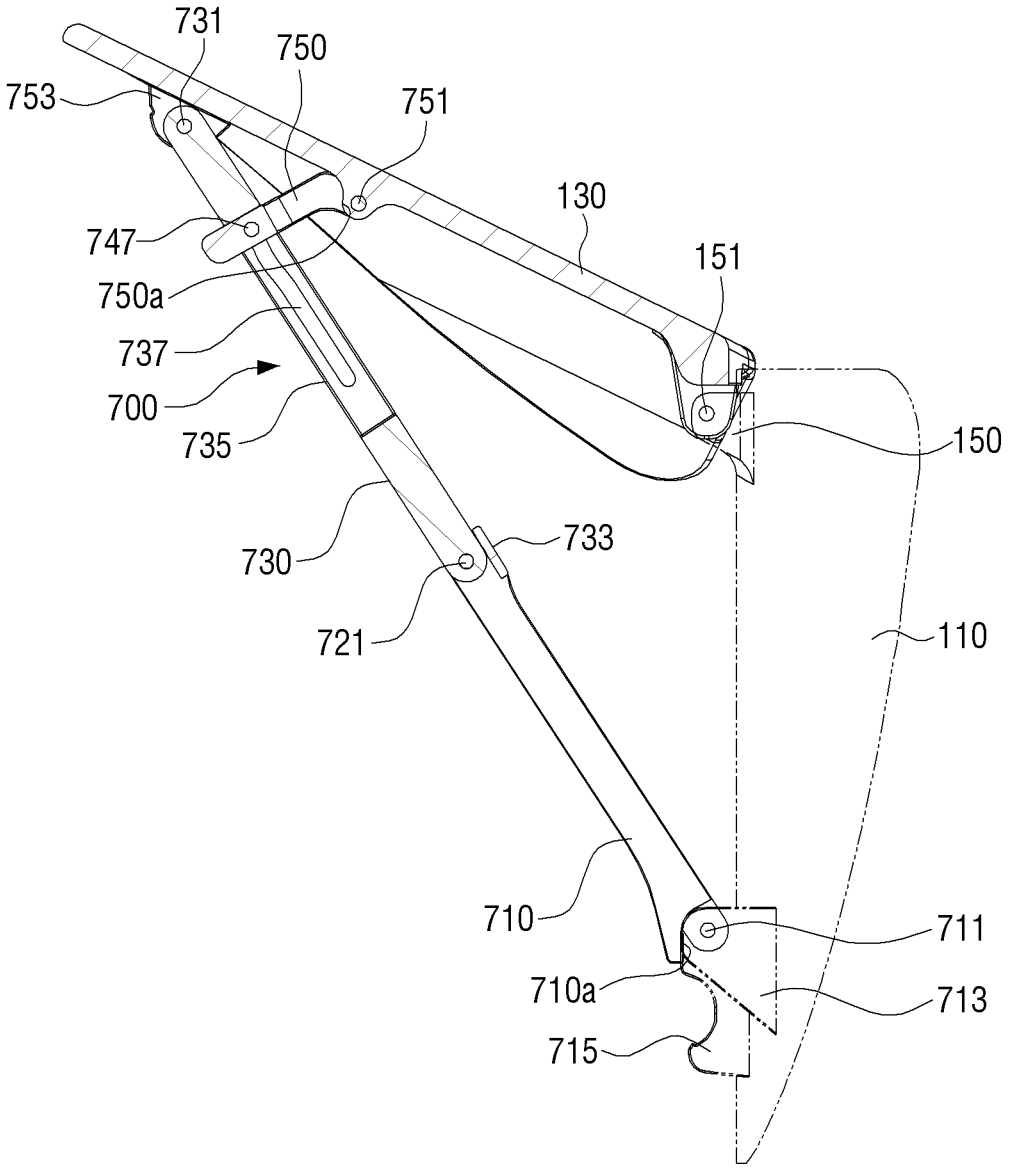
FIG. 17C is a cross-sectional diagram illustrating the load control unit taken along line M-M of FIG. 16 according to an embodiment of the present disclosure.

FIG. 17C is a cross-sectional diagram taken along line M-M of FIG. 16 according to an embodiment of the present disclosure.

Referring to FIGS. 16 to 17C, a posture maintaining unit 700 of the load control unit 100 according to another embodiment may include a supporting member 700 configured of a first link 710, a second link 730, and a third link 750.

One end of the first link 710 may be hinge-coupled to the base 110 and one end of the second link 730 may be hinge-coupled to the hipseat 130 and the other end of the second link 730 may be hinge-coupled to the other end of the first link 710. One end of the third link 750 may be hinge-coupled to the hipseat 130 and the other end of the third link 750 may be slidably coupled to the second link 730.

A first hinge shaft 711 rotatably coupled to the base 110 (e.g., at hinge portion 713) may be disposed in the one end of the first link 710 and a second hinge shaft 731 rotatably coupled to the hipseat 130 may be disposed in the one end of the second link 730. A third hinge shaft 721 configured to couple the first link 710 and the second link 730 may be disposed in the other end of the first link 710 and the other end of the second link 730. The first link 710 and the second link 730 may be rotated in association with each other through the third hinge shaft 721. A supporting end 733 formed to protrude toward the second link 730 may be further included in a rear surface of the other end of the first link 710. In response to the hipseat 130 being located in the second posture, the supporting end 733 may serve to prevent the first link 710 from being rotated to a direction opposite to the base 110. The supporting end 733 may be formed to support a rear surface of the second link 730.

A fourth hinge shaft 751 rotatably coupled to the hipseat 130 may be disposed in the one end of the third link 750. The other end of the third link 750 may be disposed in the center of the second link 730 to slidably move along the second link 730.

In response to the hipseat 130 being located to the second posture, the first link 710 and the second link 730 are arranged on the straight line. The third link 750 may support the second link 730 so that the first link 710 and the second link 730 are maintained on the straight line.

The third link 750 may form a truss structure to support the second link 730. The hipseat 130, the second link 730, and the third link 750 may be mutually arranged to form a triangular shape. The load applied to the hipseat 130 may be applied to the third link 750 and the third link 750 may fix the second link 730 and the first link 710 to be arranged on the straight line.

A plurality of first links 710 may be formed. For example, first links 710*a* and 710*b* may be formed to be disposed in a right side and a left side of the second link 730. A pair of first links 710 may be hinge-coupled to the second hinge 730. The third hinge shaft 721 may simultaneously hinge-couple the pair of first links 710 and the second link 730.

The second link 730 may be disposed between the pair of first links 710 and the second link 730 may be hinge-coupled to the first link 710 to be rotated in association with the first link 710. A moving hole 737 which one end of the third link 750 is inserted thereinto and the third link 750 moves along a length direction of the second link 730 may be formed in a central portion of the second link 730. A guide groove 735 may be formed in either side of the moving groove 737 along the length direction of the second link 730.

A guide protrusion 747 disposed in the guide groove 735 of the second link 730 may be formed in either side surface of the third link 750.

A process of changing the hipseat 130 of the load control unit 100 from any one posture of the first and second postures to the other posture of the first and second postures will be described below.

In response to the load control unit 100 being changed from the first posture to the second posture, the folded first link 710 may be unfolded to a direction far away from the base 110 and the folded second link 730 may be unfolded to a direction far away from the hipseat 130. In response to the first link 710 and the second link 730 being arranged on the straight line, the user may move the third link 750 to a direction close to the hipseat 130 so that the third link 750 may support the first link 710 and the second link 730 to be maintained on the straight line. The third link 750 may form a triangular shape in an inner side thereof with the second link 730 and the hipseat 130. Accordingly, the truss structure may be formed and the load applied to the hipseat 130 may be supported through the truss structure.

In response to the load control unit 100 being located in the first posture, the first link 710, the second link 730, and the third link 750 may be folded to overlap each other.

In response to the load control unit 100 being changed from the second posture to the first posture, the user may move the third link 750 to the direction far away from the hipseat 130. The user may move the third link 750 along the length direction of the second link 730 and release the locking of the hipseat 130 fixed to the second posture. As the third link 750 moves to a direction far away from the hipseat 130, the truss structure formed through the second link 730, the hipseat 130, and the third link 750 may be collapsed and the fixing of the second link 730 and the first link 710 may be released.

Accordingly, the first link 710 may be rotated to a direction close to the base 110 and the second link 730 may be rotated to a direction close to the hipseat 130. The third link 750 may be disposed in an inner side of the moving groove 737 of the second link 730 and the second link 730 may be disposed between the pair of first links 710. In response to the hipseat 130 being located in the first posture, the first to third links 710, 730, and 750 may be folded to overlap each other. A portion of the second link 730 coupled through the third hinge shaft 721 may be rotated to a direction far away from the base 110. The first link 710 may be folded so that the third hinge shaft 721 coupled to the second link 730 is located in a lower side than the first hinge shaft 711 coupled to the base 110. The second link 730 may be folded so that the third hinge shaft 721 coupled to the first link 710 may be located in a lower side than the second hinge shaft 731 coupled to the hipseat 130.

As the first and second links 710 and 730 may be folded to overlap each other, the hipseat 130 and the base 110 may be folded in a compact manner.

A second hinge receiving part 753 hinge-coupled to the second link 730 may be formed in the hipseat 130 and a fixing groove 715 to which the second hinge receiving part 753 is detachably fixed in the first posture may be formed in the base 110. In response to the hipseat 130 being located in the first posture, the second hinge receiving part 753 may be inserted into the fixing groove 715. Accordingly, the hipseat 130 and the base 110 may be folded in a further compact manner.

Figure 18:
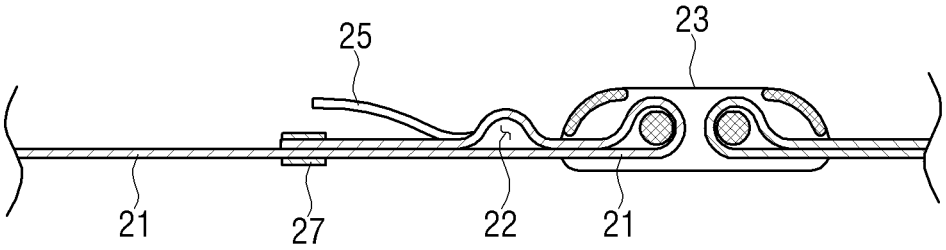
FIG. 18 is a perspective view illustrating a pull handle provided in a shoulder band or a waist band of a baby carrier according to an embodiment of the present disclosure.

FIG. 18 is a perspective view illustrating a pull handle provided in a shoulder band or a waist band of a baby carrier according to an embodiment of the present disclosure.

Referring to FIG. 18, a fixing ring 27 may be further attached to a general band adjustment apparatus. In general, a spare portion of a base band 21 remaining after a length of the base band 21 is adjusted may dangle and may provide a dirty outer appearance. Accordingly, the remaining spare portion of the base band 21 may be fixed through the fixing ring 27 to overcome the dirty outer appearance. The base band 21 may be fastened by a fastening buckle 23.

A pull handle 25 may be further attached to adjust the length of the base band 21 in response to the fixing ring 27 being applied. The pull handle 25 may be attached to the left and right shoulder bands 20*a* and 20*b* or the waist band 30. The lengths of the left and right shoulder bands 20*a* and 20*b* or the length of the waist band 30 may be easily adjusted through the pull handle 25.

It may be difficult to adjust the length of the base band 21 due to applying of the fixing ring 27. To solve the difficulty in adjusting the length of the base band 21, the pull handle 25 configured to adjust the length of the general base band 21 may be further attached. The user may pull up the pull handle 25 to adjust the lengths of the left and right shoulder bands 20*a* and 20*b* or the length of the waist band 30 and thus a space 22 may be formed as the folded based band 21 is lifted. Then, the user may pull down the pull handle 25 to adjust the lengths of the left and right shoulder bands 20*a* and 20*b* or the length of the waist band 30. Portions of the pull handle 25 and the base band 21 remaining after the length adjustment may be neatly arranged through the fixing ring 27.

Figure 19:
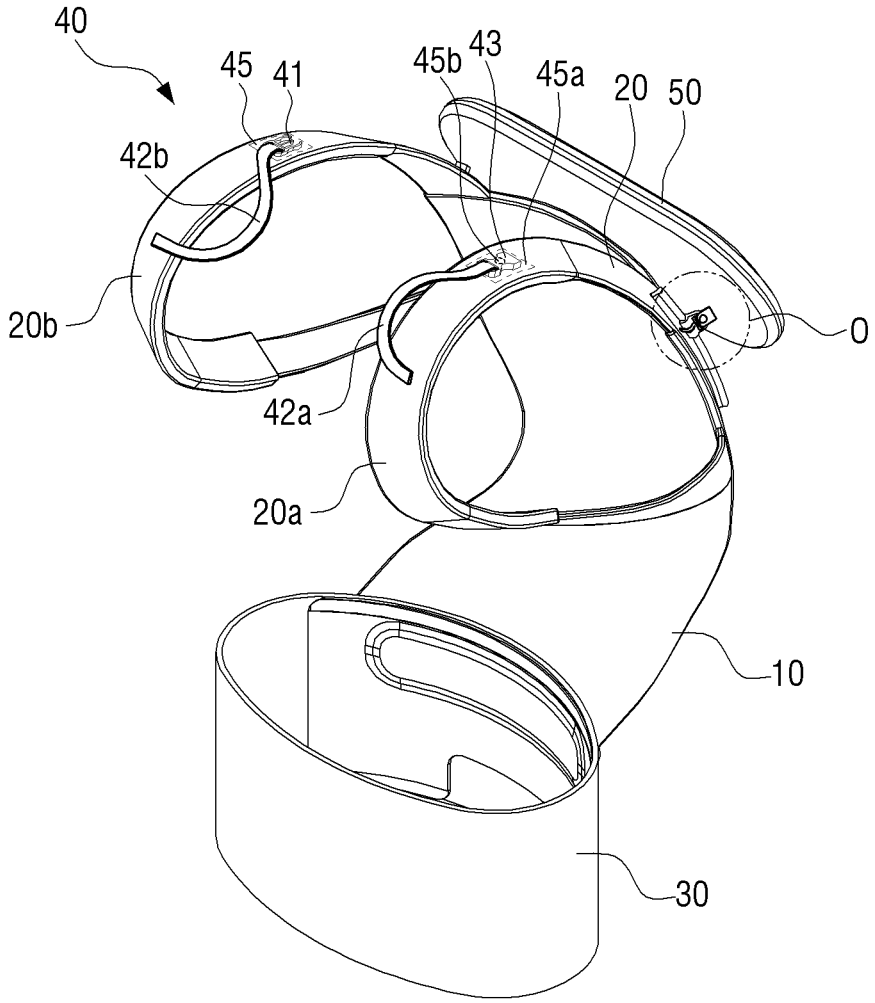
FIG. 19 is a perspective view illustrating an example that a rear fixing member of a baby carrier is attached to a should band according to an embodiment of the present disclosure.

FIG. 19 is a perspective view illustrating an example that a rear fixing member of a baby carrier is attached to a shoulder band according to an embodiment of the present disclosure.

Referring to FIG. 19, in a rear surface of the baby carrier 1 according to an embodiment, the fastening member 40 may be disposed to be fixed to a front side of the baby carrier.

The fastening member 40 may include the first and second belts 42*a* and 42*b* coupled to the left and right shoulder bands 20*a* and 20*b* and the buckles 41 and 43 provided in one end portions of the first and second belts 42*a* and 42*b*. The first and second belts 42*a* and 42*b* may be detachably fastened through the buckles 41 and 43.

It may be difficult for the user to find a position of the fastening member 40 according to a body type of the user and thus it may be difficult for the user to wear the baby carrier 1 by his/herself. Accordingly, the fastening member 40 may be fixed to the front side of the baby carrier all the time in an unfastening state of the fastening member 40 in order for the user to easily fasten the fastening member 40.

A magnetic fixing unit 45 may be provided in the fastening member 40 and magnets 45*b* having a different polarity from a magnet 45*a* formed in the fastening member 40 may be provided even in the left and right shoulder bands 20*a* and 20*b*. Accordingly, the fastening member 40 may be detachably disposed in front sides of the left and right shoulder bands 20*a* and 20*b*.

Accordingly, since the fastening member 40 is always located in the front side of the baby carrier 1, the user may wear the baby carrier 1 and then easily fasten the fastening member 40.

It has been described in the embodiment that the fixing unit configured to detachably fix the fastening member 40 to the front sides of the left and right shoulder bands 20*a* and 20*b* is a magnet, but this is not limited thereto. Any fixing unit configured to detachably fix the fastening member 40 to the front sides of the left and right shoulder bands 20*a* and 20*b* in a state that the baby carrier 1 is not worn may be employed as the fining unit 45.

Figure 20A:
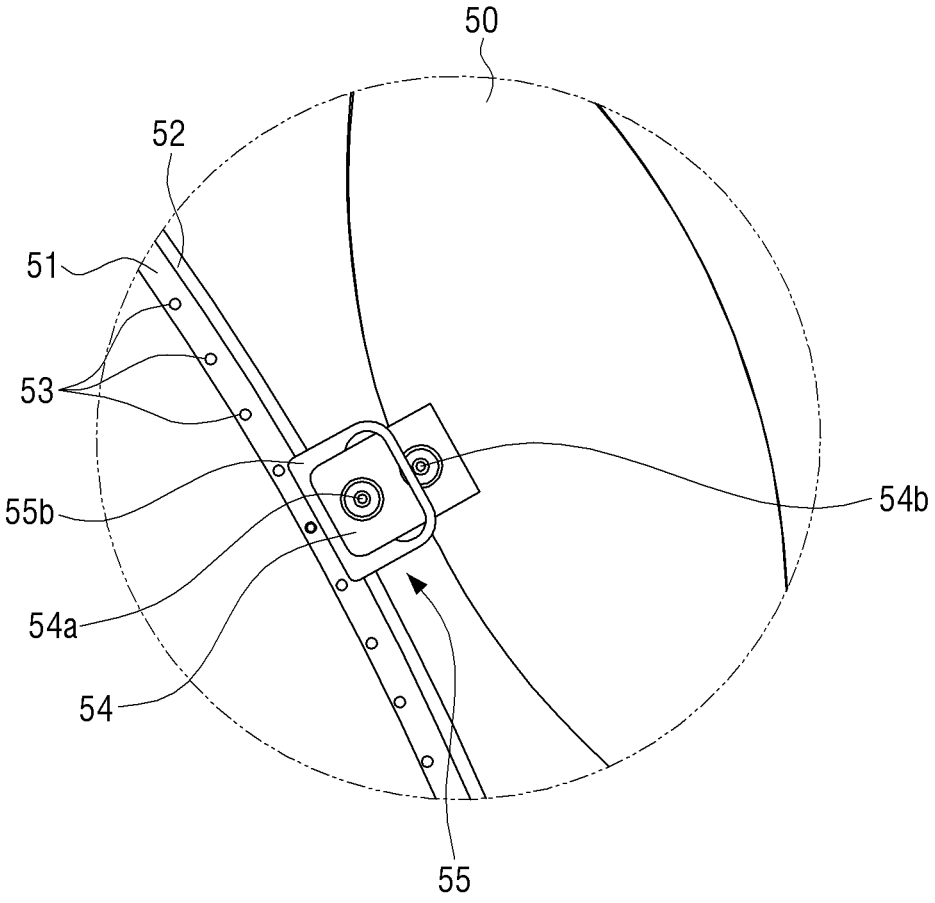
FIG. 20A is an enlarged view illustrating an "O" portion illustrated in FIG. 19 according to an embodiment of the present disclosure.
Figure 20B:
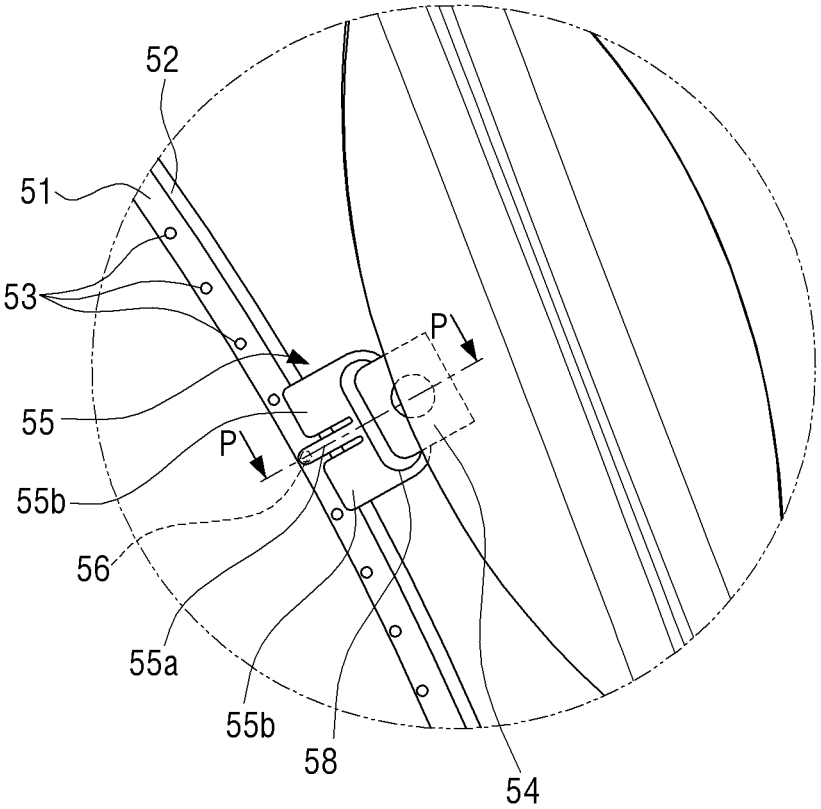
FIG. 20B is an enlarged view illustrating a rear of an "O" portion illustrated in FIG. 19 according to an embodiment of the present disclosure.

FIGS. 20A and 20B are enlarged diagrams illustrating an "O" portion and a rear of the "O" portion illustrated in FIG. 19 according to an embodiment of the present disclosure.

Figure 20C:
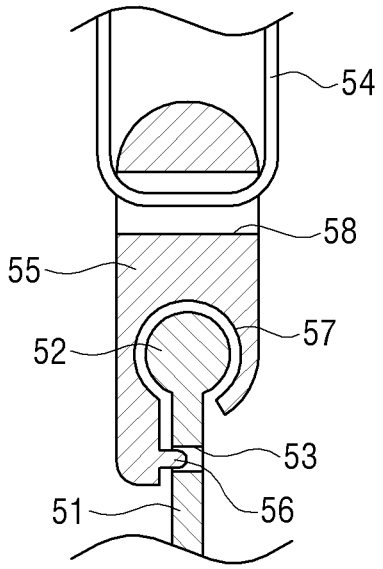
FIG. 20C is a cross-sectional diagram illustrating the "O" portion taken along line P-P of FIG. 20B according to an embodiment of the present disclosure.

FIG. 20C is a cross-sectional diagram taken along line P-P of FIG. 20B according to an embodiment of the present disclosure.

Referring to FIGS. 20A to 20C, the baby carrier 1 according to an embodiment may include the headrest 50 which is vertically movable.

The headrest 50 may be formed to be movable along the rail 51 disposed in the body part 10 and the left and right shoulder bands 20*a* and 20*b* of the baby carrier 1. The rail 51 may be disposed in a portion of the body part 10 and portions of the left and right shoulder bands 20*a* and 20*b*. The rail 51 may be concavely curved to correspond to curved shapes of the body part 10 and the left and right shoulder bands 20*a* and 20*b*. A plurality of grooves 53 may be formed in the rail 51 along a length direction of the rail 51. A guide part 52 configured to guide the headrest 50 to the length direction of the rail 51 may be formed in upper sides of the plurality of grooves 53. The guide part 52 may be formed to protrude toward the outside along the length direction of the rail 51.

A movable member 55 coupled to the headrest 50 and configured to move along the rail 51 may be disposed in the rail 51. A coupling portion 55*a* of which a fixing protrusion 56 is formed in one side and a guide groove 57 into which the guide part 52 is inserted may be formed in the movable member 55. The movable member 55 may further include a guide moving portion 55*b* formed to surround a portion of the guide part 52 so that the movable member 55 is not deviated from the guide part 52 of the rail 51. The guide groove 57 may be formed in a lower end of the movable member 55 and when viewed in a rear as illustrated in FIG. 20B, the coupling portion 55*a* may be formed in a central portion of the movable member 55 and the guide moving portions 55*b* may be formed in both ends of the movable member 55. The coupling portion 55*a* may be disposed in the central portion of the movable member 55 and thus the movable member 55 may be firmly fixed in a specific position after moving. When viewed in a front as illustrated in FIG. 20A, the movable member 55 may be configured of only the guide moving portion 55*b*.

The coupling portion 55*a* may be formed to extend longer than the guide moving portions 55*b* and may extend to be in contact with the groove 53 of the rail 51. The fixing protrusion 56 formed to protrude to a rail 51 direction may be provided in one end of the coupling portion 55*a*. As illustrated in FIG. 20C, the fixing protrusion 56 may be formed to be inserted into the groove 53 of the rail 51. The fixing protrusion 56 may have a circular cross-section to be inserted into the groove 53 of the rail 51. The groove 53 of the rail 51 may be formed to have a width slightly larger than a diameter of the fixing protrusion 56. The fixing protrusion 56 may be formed to have a length slightly smaller than the width of the rail 51. The fixing protrusion 56 of the movable member 55 may be inserted into the groove 53 of the rail 51 and thus the position of the headrest 50 may be fixed.

The headrest 50 may move along the length direction of the rail 51. One end of the movable member 55 may be coupled to the headrest 50 and the other end of the movable member 55 may be movably disposed in the rail 51. The movable member 55 may move to the length direction of the rail 51 along the guide part 52 of the rail 51 and the fixing protrusion 56 of the coupling portion 55*a* of the movable member 55 may be inserted into the groove 53 of the rail 51. Accordingly, the movable member 55 may be fixed to the position and the final position of the headrest 50 may be fixed.

The headrest 50 may be coupled to the movable member 55 through a connection member 54. The connection member 54 may be formed in a portion of the headrest 50. A connection groove 58 to which the connection member 54 may be couple in a ring shape may be formed in the movable member 55. One end of the connection member 54 may be formed to extend from the headrest 50. Members 54*a* and 54*b* which may be snap-coupled to each other may be disposed in the connection member 54. Any members snap-coupled to each other may be employed as the members 54*a* and 54*b*. In response to the other end of the connection member 54 being inserted into the connection groove 58 of the movable member 55 and the members 54*a* and 54*b* being snap-coupled to each other, the headrest 50 and the movable member 55 may be coupled to each other. The headrest 50 may be detachably attached to the movable member 55 through the connection member 54.

As the headrest 50 of the baby carrier 1 vertically moves, the position of the headrest 50 may be changed according to the developing status and posture of the baby.

Figure 21:
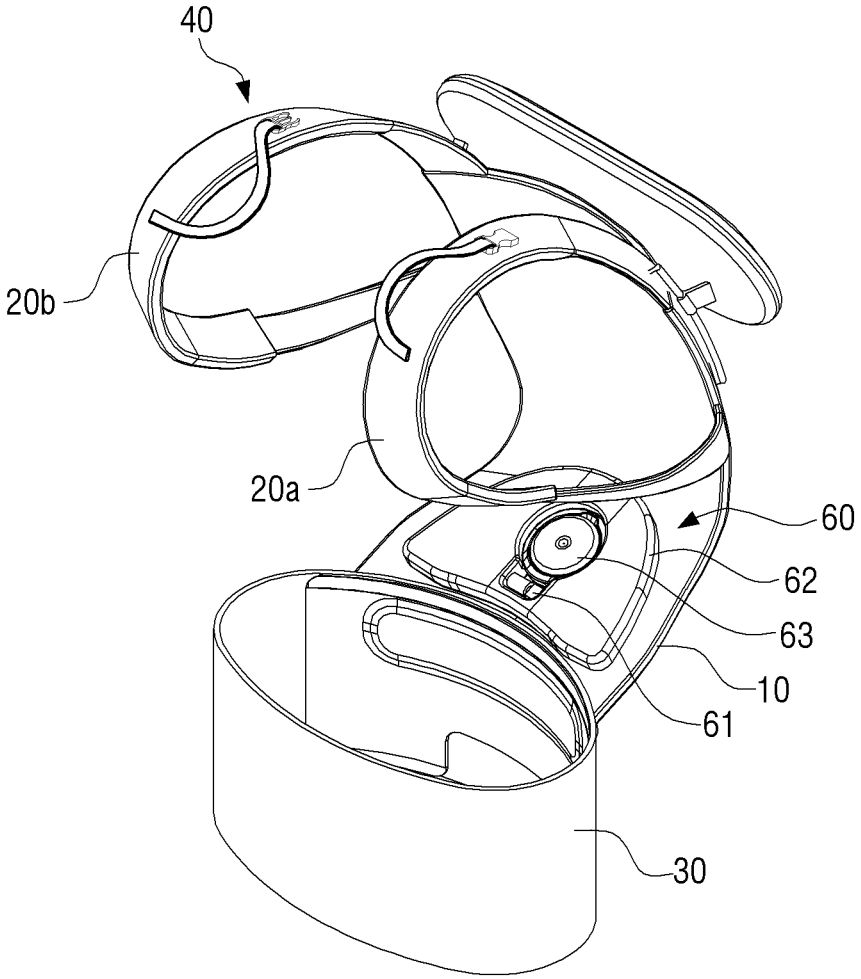
FIG. 21 is a perspective view illustrating an example that a sensing unit is provided in a baby carrier according to an embodiment of the present disclosure.

FIG. 21 is a perspective view illustrating an example that a sensing unit is provided in a baby carrier according to an embodiment of the present disclosure.

Figure 22:
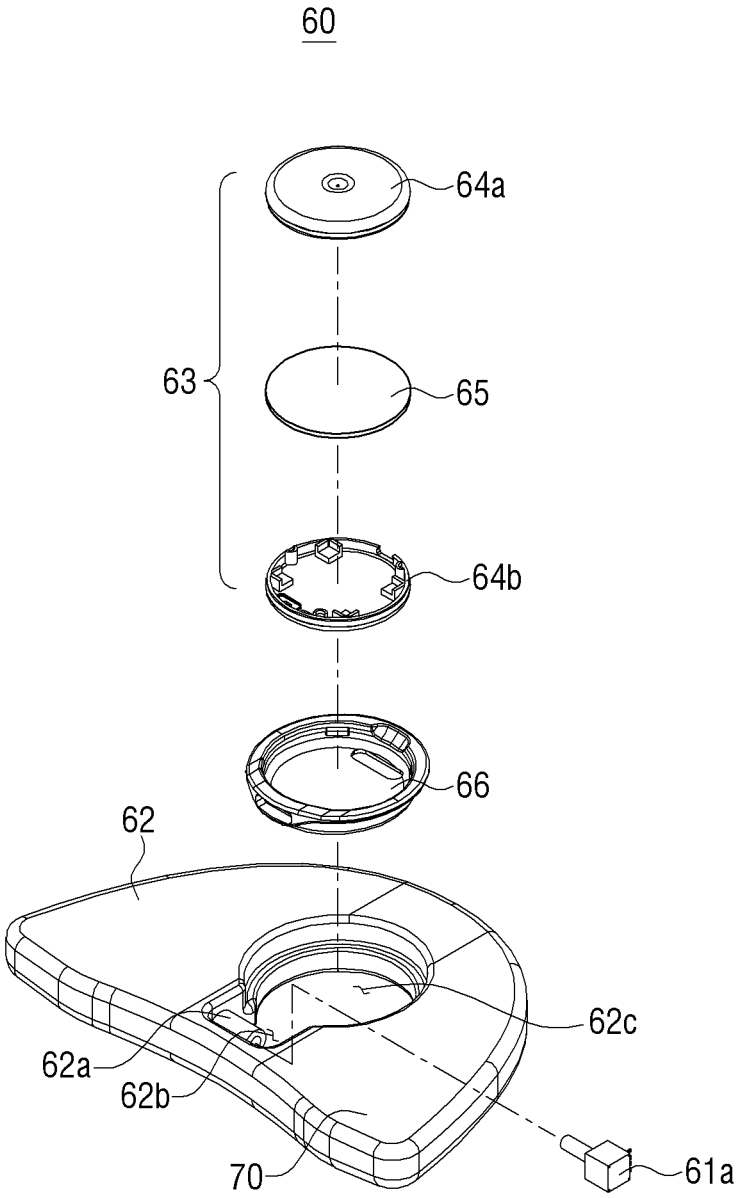
FIG. 22 is an exploded perspective view illustrating the sensing unit illustrated in FIG. 21 according to an embodiment of the present disclosure.

FIG. 22 is an exploded perspective view illustrating the sensing unit illustrated in FIG. 21 according to an embodiment of the present disclosure.

Referring to FIG. 21, in the baby carrier 1 according to an embodiment, a sensing unit 60 (e.g., a sensor) configured to support the baby may be disposed in the body part 10. The sensing unit 60 may be located in the inside of the body part 10 of the baby carrier and the body of the baby may not be in direct contact with the sensing unit 60.

Figure 24:
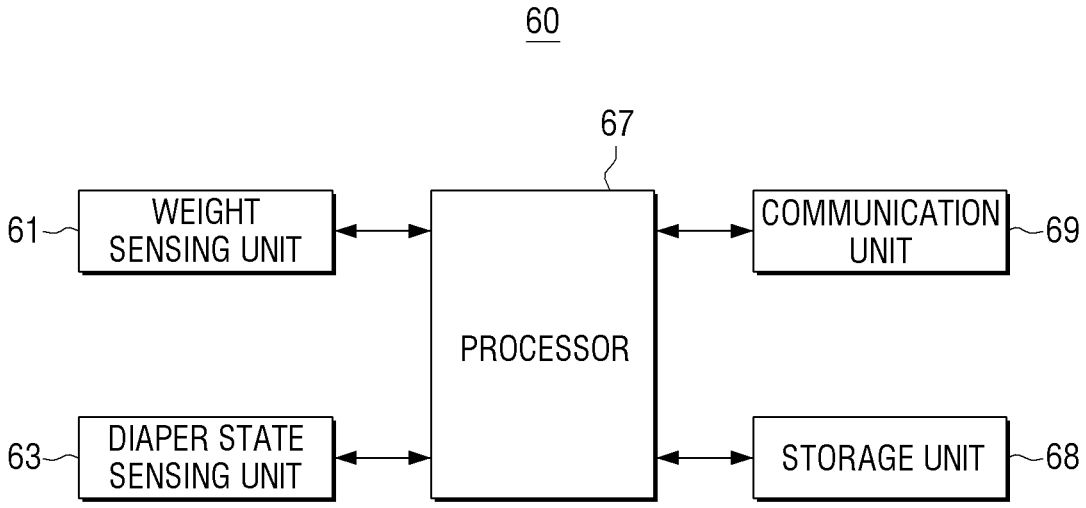
FIG. 24 is a block diagram illustrating a configuration of a sensing unit according to an embodiment of the present disclosure.

Referring to FIG. 22, the sensing unit 60 may include a weight sensing unit 61, a diaper state sensing unit 63 (e.g., a diaper state sensor), a processor or at least one processor 67 (shown in FIG. 24), a communication unit or transceiver 69 (shown in FIG. 24), and a storage unit or memory 68 (shown in FIG. 24).

The sensing unit 60 may be disposed in the body part 10 so that the hip of the baby is located in the sensing unit 60.

The weight sensing unit 61 (e.g., a weight sensor) may include an air tube 62 and a pressure sensor 61*a*. A connection port 62*a* configured to couple an inner side of the air tube 62 and the pressure sensor 61*a* and a first receiving groove 62*b* in which the pressure sensor 61*a* may be disposed may be formed in the air tube 62. The connection port 62*a* may be disposed to couple the pressure sensor 61*a* to the inner side of the air tube 62. The first receiving groove 62*b* may be disposed coupled to the inner side of the air tube 62. Accordingly, the pressure sensor 61*a* may be disposed in the first receiving groove 62*b* to detect pressure change of the air tube 62.

The pressure of the air tube 62 before and after the baby sits on the sensing unit 60 may be measured through the pressure sensor 61*a* and the weight of the baby may be detected through the measured value. As the sensing unit 60 on which the baby sits is configured of the air tube 62 and includes the pressure sensor 61*a*, the weight of the baby who sits on the baby carrier 1 may be detected through the pressure sensor and the sensing unit may notify the user of the weight of the baby in the growth of the baby.

The diaper state sensing unit 63 may include sensors configured to measure temperature, humidity, and gas or an integrated sensor 65 thereof.

The integrated sensor 65 may be disposed in an upper frame 64*a* and a lower frame 64*b* and may be disposed in the inner side of the air tube 62 in an inserted state into a cradle 66. A second receiving groove 62*c* configured to receive the diaper state sensing unit 63 may be formed in the air tube 62. The second receiving groove 62*c* may be formed in the center of the air tube 62 to be close to the body of the baby or a diaper worn by the baby. In response to the baby being sat, the diaper state sensing unit 63 may detect temperature, humidity, and gas around the sensing unit 60. A 6-axis sensor (an acceleration sensor+a gyro sensor) may be further included and thus the sloping degree of the baby carrier may be detected in wearing of the baby carrier.

Figure 23:
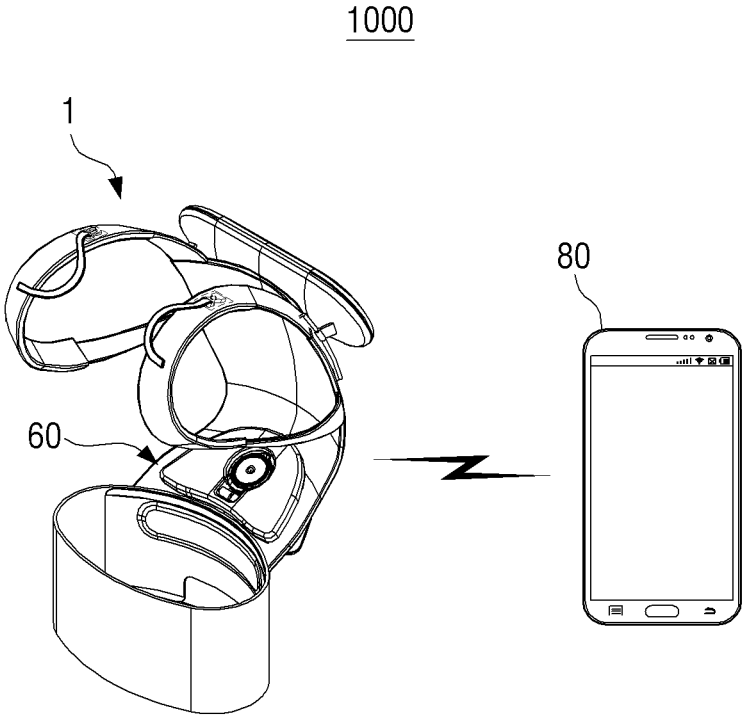
FIG. 23 is a diagram illustrating a configuration of a state monitoring system of a baby and a diaper using a sensing unit according to an embodiment of the present disclosure.

FIG. 23 is a diagram illustrating a configuration of a state monitoring system of a baby and a diaper using a sensing unit according to an embodiment of the present disclosure.

Referring to FIG. 23, a baby and diaper state monitoring system 1000 using an external apparatus according to an embodiment may include a sensing unit 60 attached to be close the diaper of the baby and an external apparatus 80 of the user. The sensing unit 60 which is close to the body of the baby (or the diaper worn by the bay) may measure the diaper state and the weight of the baby. For example, the sensing unit 60 may detect temperature, humidity, gas, and pressure. The sensing unit 60 may be close to the diaper of the baby and may measure signals related to the diaper state of the baby and the weight of the baby. The sensing unit 60 may transmit the measured signals for the baby to the external apparatus 80.

The external apparatus 80 of the user may receive a plurality of signals measured from the sensing unit 60. The external apparatus 80 of the user may calculate the weight of the baby using the plurality of received signals and determine the diaper state of the baby. For example, the external apparatus 80 of the user may display the wright of the baby based on the plurality of received signals and represent the diaper state of the baby with weather. The user may determine the baby state as one of a sunny state, a cloudy state, a rainy state, and a thunder state according to the diaper state.

For clarity, it has been described and illustrated that the external apparatus 80 of the user is a smart phone of the user, but the external apparatus 80 of the user may be substantially implemented with a display device such as a smart television (TV), a tablet personal computer (PC), a portable multimedia player (PMP), a personal digital assistant (PDA), or a smart watch or a lamp (not shown) configured to provide the alarm through change in light of a light emitting diode (LED).

FIG. 24 is a block diagram illustrating a configuration of a sensing unit according to an embodiment of the present disclosure.

Referring to FIG. 24, the sensing unit 60 according to an embodiment may include the weight sensing unit 61 (e.g., a weight sensor), the diaper state sensing unit 63 (e.g., a diaper state sensor), the processor 67, the communication unit or transceiver 69, and the storage unit or memory 68.

The sensing unit 60 according to an embodiment may be disposed close to the diaper of the baby and may measure a plurality of signals related to the baby and the diaper.

The weight sensing unit 61 may measure a signal relate to the weight of the baby. For example, the weight sensing unit 61 may be configured of the pressure sensor 61*a* and the air tube 62. The pressure sensor 61*a* may be disposed to measure the pressure of the air tube 62. The pressure sensor 61*a* may detect the pressure change of the air tube 62. The pressure sensor 61*a* may measure the physical change such as air pressure, a magnitude of force, and the like through the air tube 62.

The diaper state sensing unit 63 may measure the signal related the diaper state of the baby. For example, the diaper state sensing unit 63 may include a temperature sensor, a humidity sensor, a gas sensor, or an integrated sensor 65 thereof.

The diaper state sensing unit 63 may be disposed close to the diaper of the baby and may detect temperature, humidity, and gas of the diaper. The diaper state sensing unit 63 may measure the state of the diaper through detected values. To couple the sensing unit 60 and the external apparatus 80 of the user, the communication unit 69 may use a wired communication method which couples the sensing unit 60 to the external apparatus through a local area network (LAN) and an Internet network or a wireless communication method (for example, Global System for Mobile communications (GSM), universal mobile telecommunications system (UMTS), long term evolution (LTE), wireless broadband internet (WiBRO), Wireless Fidelity (WiFi), Bluetooth (BT), and the like).

The communication unit 69 may transmit the plurality of signals measured through the weight sensing unit 61 and the diaper state sensing unit 63 or result values processed through the processor 67 to the external apparatus 80 of the user according to an embodiment. The communication unit 69 may determine the weight of the baby determined based on the plurality of signals for the baby measured through the weight sensing unit 61 and the diaper state sensing unit 63 or may transmit information for the diaper state of the baby to the external apparatus.

The storage unit 68 may store the plurality of signals measured through the weight sensing unit 61 and the diaper state sensing unit 63.

The processor 67 may control the weight sensing unit 61 and the diaper state sensing unit 63 to measure a plurality of pieces of information for the baby and the diaper. The processor 67 may control the communication unit 69 to transmit the plurality of measured signals to the external apparatus 80.

The processor 67 may control the storage unit 68 to store a plurality of bio-signals measured through the weight sensing unit 61 and the diaper state sensing unit 63.

The processor 67 may determine the wright of the baby or the diaper state of the user using the plurality of measured signals.

Figure 25:
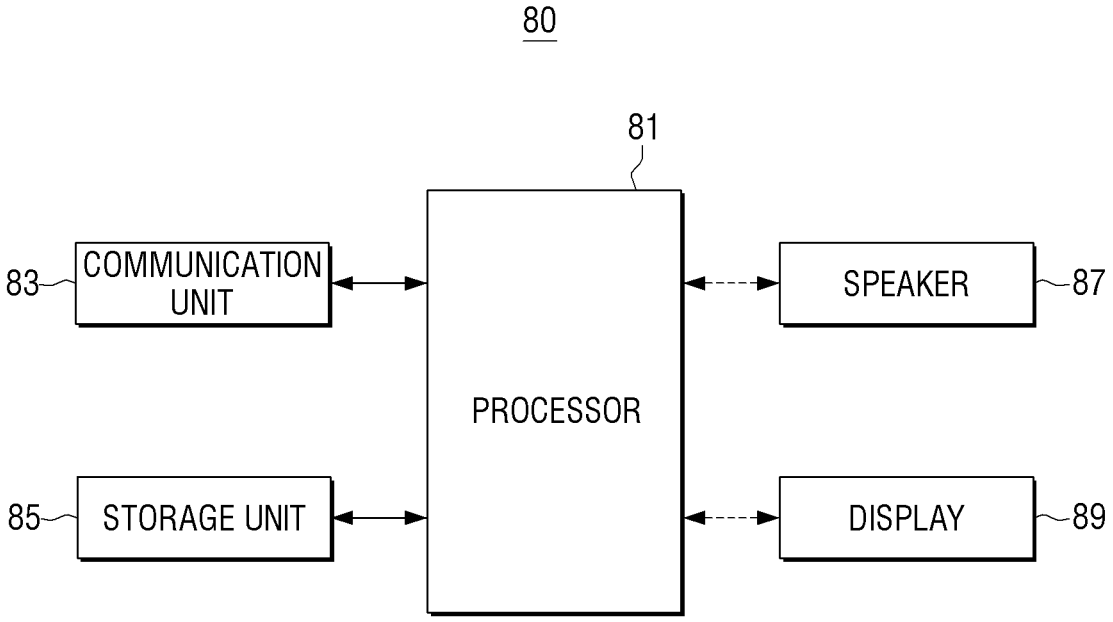
FIG. 25 is a block diagram illustrating a configuration of an external apparatus according to an embodiment of the present disclosure.

FIG. 25 is a block diagram illustrating a configuration of an external apparatus according to an embodiment of the present disclosure.

FIGS. 26A to 26D are diagrams illustrating an example that a state of a baby detected through a sensing unit is displayed in a display of a smart phone according to an embodiment of the present disclosure.

Referring to FIG. 25, the external apparatus 80 of the user may include a communication unit or transceiver 83, a storage unit or memory 85, a speaker 87, a display 89, and a processor or at least one processor 81.

The external apparatus 80 of the user may determine the weight of the baby or the diaper state of the baby by receiving the plurality of signals for the weight and the diaper state of the baby from the sensing unit 60. For example, the external apparatus 80 of the user may be a display device which may be portable through the user such as a smart phone, a tablet PC, a PMP, a PDA, and a smart watch or a display device which may not be portable through the user such as a smart TV. In another example, the external apparatus 80 of the user may be a lamp and the like configured to provide the alarm through change in light of a LED.

To couple the sensing unit 60 and the external apparatus 80 of the user, the communication unit 83 may use a wired communication method which couples the sensing unit and the external apparatus through a local area network (LAN) and an Internet network or a wireless communication method (for example, GSM, UMTS, LTE, WiBRO, WiFi, BT, and the like).

The communication unit 83 may receive the signal for the weight of the baby and the signal for the diaper state of the baby measured through the sensing unit 60.

The processor 81 may determine the weight of the baby using the pressure signal received through the communication unit 83. For example, the processor 81 may output the weight of the baby using a Fussy algorithm based on the received pressure signal. Accordingly, the weight of the baby may be easily measured in home.

It has been described that the algorithm for estimating the weight and determining the diaper state is processed in the processor 81 of the external apparatus, but this is not limited thereto. The algorithm for estimating the weight and determining the diaper state may be processed through the processor 67 of the sensing unit 60 included in the baby carrier 1.

The display 89 may display information for the measured weight of the baby.

The processor 81 may determine the diaper state of the baby using the plurality of signals received through the communication unit 83. For example, the processor 81 may represent the diaper state of the baby with weather based on the plurality of signals for the received diaper state. The processor 81 may determine the baby state as one of a sunny state, a cloudy state, a rainy state, and a thunder and lightning state according to the diaper state.

The information for the diaper state of the baby determined through the processor 67 of the sensing unit 60 or the processor 81 of the external apparatus 80 may be displayed in the external apparatus 80 of the user.

A speaker 87 may provide a sound alarm.

Figure 26A:
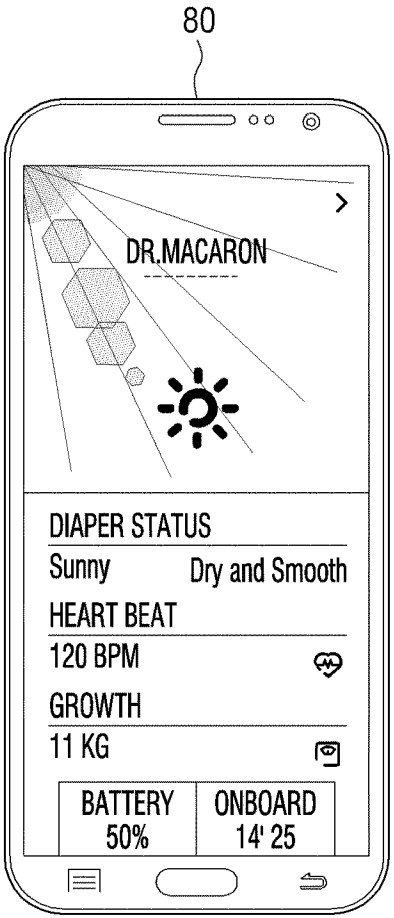
FIGS. 26A, 26B, 26C and 26D are diagrams illustrating an example that a state of a baby detected through a sensing unit is displayed in a display of an external apparatus according to an embodiment of the present disclosure.
Figure 26B:
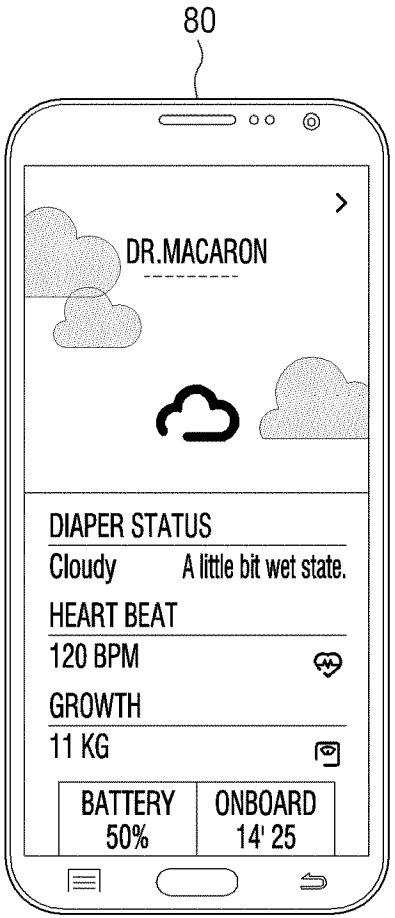
Figure 26C:
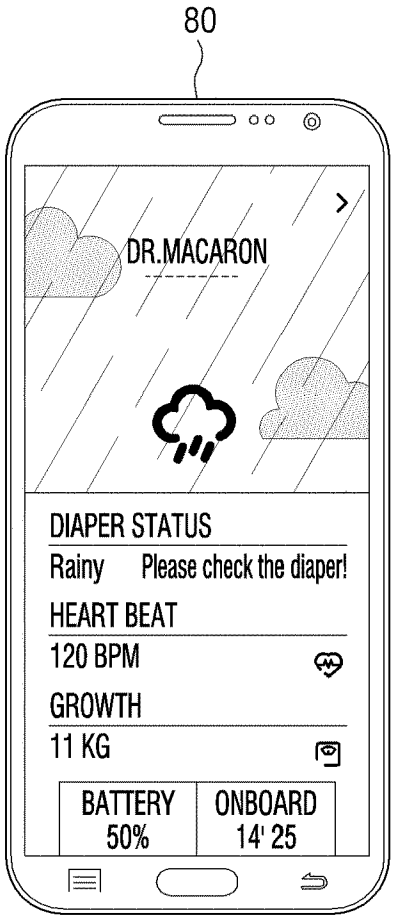
Figure 26D:
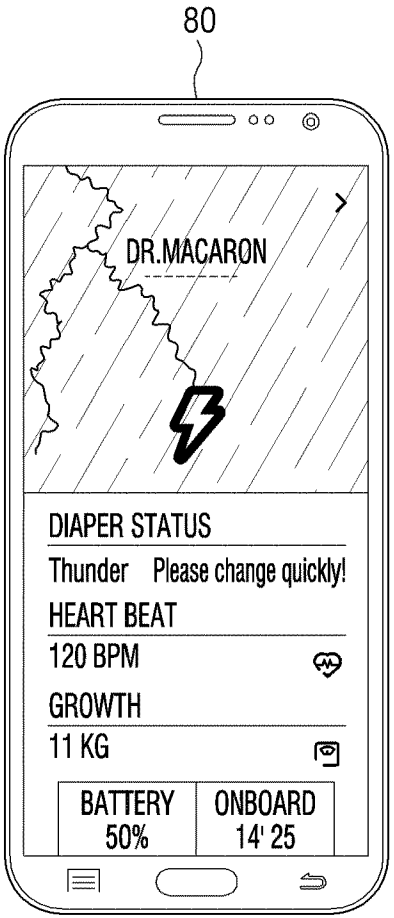

The display 89 may display the information for the diaper state of the baby. For example, as illustrated in FIG. 26A) the display 89 may display the diaper state of the baby with a sunny state in response to the diaper being in a clean state that change of the diaper being not necessary. In another example, as illustrated in FIG. 26B) the humidity of the diaper may be slightly increased and a small amount of urine may be expected. In this example, the diaper state may be displayed with a cloudy state. In another example, as illustrated in FIG. 26C, the diaper state of the baby may be displayed with a rainy state. In response to the humidity of the diaper of the baby being further increased, the diaper state may be displayed with a rainy state. In another example, as illustrated in FIG. 26D, the diaper state of the baby may be displayed with a thunder state. In this example, the thunder state may refer to a state that stool, a large amount of urine, or the like is defecated in the diaper. The sound alarm may be simultaneously provided through the speaker 87.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A baby carrier comprising:

a body part;

a pair of shoulder bands coupled to opposite sides of an upper portion of the body part;

a waist band coupled to a lower portion of the body part; and a load control unit which is coupled to the waist band and is changed to any one posture of a first posture and a second posture to switch a load-applied direction, wherein a ratio of loads applied to the shoulder bands and the waist band is changed in response to the load control unit being changed from the one posture of the first posture and the second posture to the other posture of the first posture and the second posture, wherein the load control unit does not receive a load applied to a coupling portion of the shoulder bands and the waist band in the first posture and disperses a portion of the load applied to the shoulder bands to the waist band in the second posture, wherein the load control unit includes:

a base detachably coupled to the waist band, a hipseat hinge-coupled to the base and configured to rotate to the first posture that the hipseat is folded to the base and the second posture that the hipseat is unfolded to maintain a fixed angle to the base, and a posture maintaining unit configured to maintain a position of the hipseat in the one posture of the first posture and the second posture, wherein the posture maintaining unit includes:

a locking shaft elastically movably disposed in any one of the base and the hipseat, and a locking groove which is formed in the other one of the base and the hipseat and the locking shaft is fixedly coupled thereto, wherein the locking groove includes a first groove and a second groove which the locking shaft is selectively inserted thereinto, and wherein the locking groove maintains the first posture in response to the locking shaft being inserted into the first groove and maintains the second posture in response to the locking shaft being inserted into the second groove.

2. The baby carrier as claimed in claim 1, wherein the first groove is formed in an arc shape along a rotation direction of the hipseat.

3. The baby carrier as claimed in claim 2, wherein the first groove includes a cam surface, which is inclined to a direction that a depth of the first groove is increased away from the second groove.

4. The baby carrier as claimed in claim 1, wherein the hipseat is formed to have a structure that opposite sides thereof are inclined.

* * * * *